US009591706B2

(12) United States Patent
Chou et al.

(10) Patent No.: US 9,591,706 B2
(45) Date of Patent: Mar. 7, 2017

(54) UNIVERSAL VOLTAGE LED POWER SUPPLY WITH REGENERATING POWER SOURCE CIRCUITRY, NON-ISOLATED LOAD, AND 0-10V DIMMING CIRCUIT

(71) Applicant: Enertron, Inc., Gilbert, AZ (US)

(72) Inventors: Der Jeou Chou, Mesa, AZ (US); Ming Yi Chan, Taipei (TW)

(73) Assignee: Enertron, Inc., Gilbert, AZ (US)

( * ) Notice: Subject to any disclaimer, the term of this patent is extended or adjusted under 35 U.S.C. 154(b) by 0 days.

(21) Appl. No.: 14/843,090

(22) Filed: Sep. 2, 2015

(65) Prior Publication Data

US 2015/0382417 A1 Dec. 31, 2015

Related U.S. Application Data

(63) Continuation-in-part of application No. 14/280,048, filed on May 16, 2014.

(51) Int. Cl.
*H05B 33/08* (2006.01)
*H05B 41/392* (2006.01)
(Continued)

(52) U.S. Cl.
CPC ..... *H05B 33/0815* (2013.01); *H05B 33/0887* (2013.01); *H05B 39/04* (2013.01);
(Continued)

(58) Field of Classification Search
CPC ..... H05B 39/06; H05B 37/036; H05B 1/02; H05B 33/0815; H05B 39/04; H05B 41/36; H05B 41/2828
(Continued)

(56) References Cited

U.S. PATENT DOCUMENTS 5,691,889 A * 11/1997 Bazinet ..... H02M 3/156 323/222
RE39,933 E 12/2007 Hall et al.
(Continued)

OTHER PUBLICATIONS

Fairchild Semiconductor, "Application Note AN4107 Design of Power Factor Correction Using FAN7527", pp. 1-14, Rev. 1.0.2., May 2000.

(Continued)

*Primary Examiner* — Timothy J Dole
*Assistant Examiner* — Bryan R Perez
(74) *Attorney, Agent, or Firm* — Brian M. Kaufman; Robert D. Atkins; Patent Law Group: Atkins and Associates, P.C.

(57) ABSTRACT

A light-emitting diode (LED) lighting device has an LED and a power supply including an inductor coupled to the LED. A cathode of the LED is coupled to the inductor opposite an anode of the LED. The inductor is coupled for receiving a first power signal. A transistor includes a conduction terminal coupled to the inductor to enable current through the inductor. A current from the first power signal is switched to generate a second power signal. A first diode includes an anode coupled to the inductor opposite the cathode of the LED. A controller includes a first terminal coupled to a cathode of the first diode and a second terminal coupled to a control terminal of the transistor. A dimming controller is coupled to a third terminal of the controller. A Zener diode is coupled to the first terminal of the controller.

22 Claims, 11 Drawing Sheets

(51) Int. Cl.

| | |
|---|---|
| *H05B 39/08* | (2006.01) |
| *H05B 41/36* | (2006.01) |
| *H05B 39/04* | (2006.01) |
| *H05B 41/282* | (2006.01) |

(52) U.S. Cl.
CPC ..... *H05B 39/08* (2013.01); *H05B 41/2828* (2013.01); *H05B 41/36* (2013.01); *H05B 41/3921* (2013.01)

(58) Field of Classification Search
USPC ..... 315/185 R, 209 R, 291, 299
See application file for complete search history.

(56) References Cited

U.S. PATENT DOCUMENTS

| | | | | |
|---|---|---|---|---|
| 7,883,243 | B2 | 2/2011 | Snyder | |
| 7,952,293 | B2 | 5/2011 | Kelly | |
| 8,004,260 | B2 | 8/2011 | Irving et al. | |
| 8,444,299 | B2 | 5/2013 | Chou et al. | |
| 8,476,842 | B2 * | 7/2013 | Chuang | H05B 33/0815 315/209 R |
| 8,502,463 | B2 | 8/2013 | Mizukawa et al. | |
| 8,531,112 | B2 | 9/2013 | Wang | |
| 2009/0195186 | A1 | 8/2009 | Guest et al. | |
| 2010/0052569 | A1 * | 3/2010 | Hoogzaad | H05B 33/0815 315/294 |
| 2011/0037418 | A1 * | 2/2011 | Park | H05B 33/0815 315/307 |
| 2011/0255319 | A1 | 10/2011 | Ayukawa et al. | |
| 2011/0260647 | A1 | 10/2011 | Catalano et al. | |
| 2012/0049758 | A1 * | 3/2012 | Hwang | H05B 33/0815 315/291 |
| 2013/0076246 | A1 * | 3/2013 | Okawa | H05B 33/0896 315/121 |

OTHER PUBLICATIONS

Melexis Microelectronic Integrated Systems, "Evaluation Board EVB10803 Power LED Driver for Automotive Applications", pp. 1-8, Mar. 2006.

Melexis Microelectronic Integrated Systems, "IC Specification MLX10803 High Power LED Driver", pp. 1-25, Jun. 2012.

Electronic Theater Controls "Dimming Information" pp. 1-2, Mar. 24, 2015, http://www.etcconnect.com/Community/wikis/products/dimming-information.aspx.

Illuminating Engineering Society "Lighting Control Protocols", Illuminating Engineering Society of North America, 120 Wall Street, New York, IES TM-23-11, pp. 1-41, Apr. 4, 2011.

* cited by examiner

UNIVERSAL VOLTAGE LED POWER SUPPLY WITH REGENERATING POWER SOURCE CIRCUITRY, NON-ISOLATED LOAD, AND 0-10V DIMMING CIRCUIT

CLAIM TO DOMESTIC PRIORITY

The present application is a continuation-in-part of U.S. patent application Ser. No. 14/280,048, filed May 16, 2014, which application is incorporated herein by reference.

FIELD OF THE INVENTION

The present invention relates in general to power supplies and, more particularly, to a dimmable light-emitting diode (LED) power supply with a regenerating power source, non-isolated load, and a 0-10V dimming circuit, which registers an input voltage level.

BACKGROUND OF THE INVENTION

LEDs have been used for decades in applications requiring relatively low-energy indicator lamps, numerical readouts, and the like. In recent years, the brightness and power of individual LEDs have increased substantially, resulting in the availability of devices capable of high power output.

While small, LEDs exhibit a high efficacy and life expectancy compared to traditional lighting products. A typical incandescent bulb has an efficacy of 10 to 12 lumens per watt and lasts for about 1,000 to 2,000 hours; a typical fluorescent bulb has an efficacy of 40 to 80 lumens per watt and lasts for 10,000 to 20,000 hours; a typical halogen bulb has an efficacy of 15 lumens per watt and lasts for 2,000 to 3,000 hours. In contrast, today's white LEDs can emit more than 140 lumens per watt with a life expectancy of about 100,000 hours.

Thus, LED lights are efficient, long-lasting, cost-effective, and environmentally friendly. For the above reasons, LED lighting is rapidly becoming the light source of choice in many applications. Significant interest exists in replacing lighting products currently in use, such as incandescent and compact fluorescent (CFL) bulbs, with a corresponding LED lamp that has the same form, fit, and function. For a particular lighting fixture that uses an A19 bulb, it is desirable to "swap out" a 60 W incandescent bulb with an LED lamp that emits approximately the same amount of light but has a much longer life expectancy and reduced operating cost.

LED lamp manufacturers strive to improve LED lamps. Some important ways that manufacturers can improve LED lamps is in LED emitter luminous efficacy, AC to DC power supply conversion efficiency, power factor, optics, and thermal management. Luminous efficacy is a measure of how well an LED emitter produces visible light, i.e., the ratio of visible light produced to power consumed by the LED emitter. LED lamp manufacturers want to produce LED lamps which generate more light for the same amount of energy consumed, or consume less energy yet generate the same light output. The efficiency of LED lamps can be improved by utilizing LED emitters which consume less energy when generating light, or power conversion efficiency can be improved by reducing the amount of energy consumed by control logic in the LED lamp's power supply. As lower power consumption LEDs are developed, control logic consumes a higher percentage of the total power of an LED lamp, and reducing the power consumption of the control logic has a greater effect on total efficacy.

Power factor is the ratio of real power consumed by an LED lamp and the apparent power flowing through the LED lamp's circuits. A power factor of 1 is ideal, and indicates that AC power is being utilized by an electronic circuit during the entire period of the AC sine wave, i.e., 0 to 360 degrees. With a power factor of 1, all power flowing to an LED lamp is being consumed by the LED lamp. The power factor can be lowered when the LED lamp is consuming energy for only a portion of the AC phase, or when the LED lamp is consuming power out of phase with the alternating current (AC) power source. A low power factor indicates that more current is being transmitted to the LED lamp than is actually needed to power the LED lamp. A low power factor results in unbalanced loading in the power transmission and distribution lines, and unnecessary power loss.

LED products in the United States are commonly used with either a 120 volt (V) AC supply, or a 277V supply. Making an LED product that works with both 120V and 277V supply voltages is a challenge, and providing dimming with an LED power supply that also accepts both 120V and 277V supply voltages is especially challenging. Many manufacturers in the art of LED lamps create separate products for 120V and 277V supplies. However, having separate products for each voltage increases the number of stock keeping units (SKUs) that a company must stock. In addition, if multiple power output ratings are required, a separate SKU is required for each power output at each voltage level, creating a logistical nightmare for manufacturers and distributors.

SUMMARY OF THE INVENTION

A need exists for a dimmable LED power supply with a high AC to DC conversion efficiency and power factor, which accepts the various utility voltage inputs used around the globe, e.g., 100V, 110V, 120V, 220V, 230V, 240V, 277V. Accordingly, in one embodiment, the present invention is a light-emitting diode (LED) lighting device comprising an LED. A power supply includes an inductor coupled to the LED. A transistor includes a conduction terminal coupled to the inductor to enable current through the inductor. A first diode includes an anode coupled to the inductor. A controller includes a first terminal coupled to a cathode of the first diode and a second terminal coupled to a control terminal of the transistor. A dimming controller is coupled to a third terminal of the controller.

In another embodiment, the present invention is an electronic circuit for providing a direct current (DC) power signal comprising a controller and a transistor including a control terminal coupled to a first terminal of the controller. An inductor is coupled to a conduction terminal of the transistor. A capacitor is coupled between the inductor and a second terminal of the controller.

In another embodiment, the present invention is a method of providing DC power comprising the steps of providing a first power signal, generating a second power signal by charging a circuit element with the first power signal and discharging the circuit element, powering a load with the second power signal, powering a controller with the second power signal, and controlling a frequency of the second power signal using an input to the controller.

In another embodiment, the present invention is a method of providing DC power comprising the steps of providing a first power signal, generating a second power signal from the first power signal, controlling power to a load by modifying a frequency of the second power signal, and powering a controller with the second power signal.

DETAILED DESCRIPTION OF THE DRAWINGS

The present invention is described in one or more embodiments in the following description with reference to the figures, in which like numerals represent the same or similar elements. While the invention is described in terms of the best mode for achieving the invention's objectives, one skilled in the art will appreciate that the description is intended to cover alternatives, modifications, and equivalents as may be included within the spirit and scope of the invention as defined by the appended claims and the equivalents as supported by the following disclosure and drawings.

LEDs have been used for decades in applications requiring relatively low-energy. In recent years, the brightness and power of individual LEDs have increased substantially, resulting in the availability of LED packages ranging from 0.1 watt up to 100 watt and suitable for use in larger scale lighting applications.

While small, LEDs exhibit a high efficacy and life expectancy compared to traditional lighting products. A typical incandescent bulb has an efficacy of 10 to 12 lumens per watt and lasts for about 1,000 to 2,000 hours; a typical fluorescent bulb has an efficacy of 40 to 80 lumens per watt and lasts for 10,000 to 20,000 hours; a typical halogen bulb has an efficacy of 15 lumens per watt and lasts for 2,000 to 3,000 hours. In contrast, today's white LEDs can emit more than 140 lumens per watt with a life expectancy of about 100,000 hours.

LED lighting sources provide a brilliant light, sufficient to illuminate an area in home, office, or commercial settings. LED lighting is efficient, long lasting, cost-effective, and environmentally friendly. LEDs emit light in a specific direction and light an area more efficiently than lamps that produce omni-directional light, wasting energy illuminating a ceiling, the inside of a light fixture, or other areas that do not need to be lit. LEDs are dimmable, come in a variety of color options, and have an instant turn-on unlike halogen and fluorescent lamps which require a warm-up period to achieve full brightness. Unlike a fluorescent lamp, an LED light source emits a constant, non-flickering light and can be turned on and off more rapidly than the eye can see, up to millions of times per second, with no degradation in the operating life of the LED light source. For the above reasons, LED lighting is rapidly becoming the light source of choice in many applications.

LED lighting relies on LED emitters or light engines to generate the light energy emitted from an LED light source. A light engine consists of a plurality of individual LED devices electrically interconnected over a substrate. A power supply energizes the LED devices via connection terminals on the substrate, and the energized LEDs produce light.

Figure 1A:
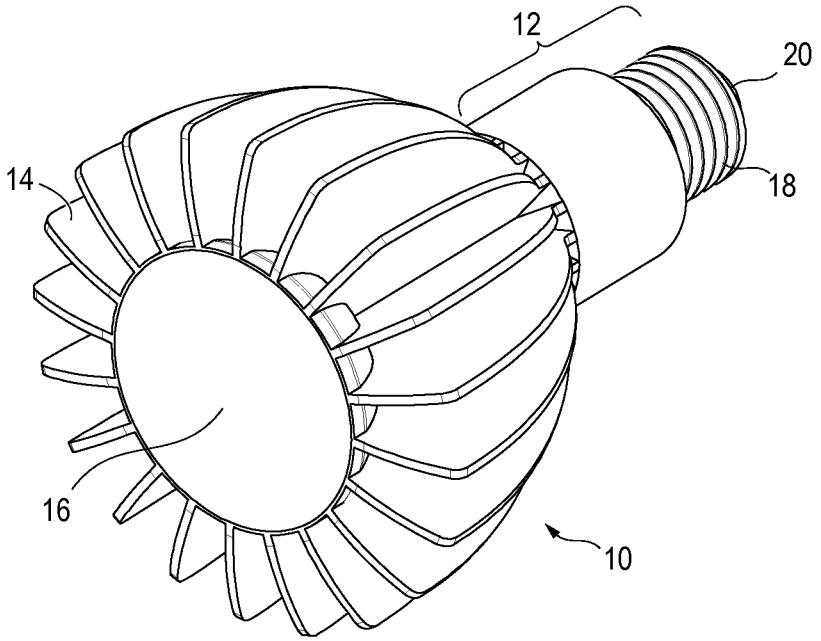
FIGS. 1*a*-1*b* illustrate an LED lamp.

FIG. 1*a* illustrates an LED lamp 10. The external components of LED lamp 10 include base 12, heatsink 14, and window or lens 16. Base 12 is screwed or snapped onto heatsink 14, or held onto the heatsink by other suitable means. Lens 16 is mounted to heatsink 14 using friction coupling, fasteners, adhesive, or another suitable attachment mechanism, and encloses the internal components of LED lamp 10.

LED lamp 10 replaces an incandescent light bulb in a common household light bulb socket. Base 12 is configured to fit an E26 or E27 light bulb socket. Threads 18 provide a screw-like interface to the light bulb socket, and hold LED lamp 10 into the socket. Threads 18 are electrically connected to a power supply board internal to LED lamp 10. The light bulb socket includes metal threads that correspond to threads 18 on LED lamp 10. When LED lamp 10 is fully screwed into the light bulb socket, friction between the metal threads of the socket and threads 18 provides grip to hold the LED lamp in the socket, as well as electrical connection between threads 18 and the neutral wire of the alternating current (AC) supply. The light bulb socket holds LED lamp 10 stationary via base 12 so that light emanating from the LED lamp illuminates a fixed area.

Tip 20 is electrically connected to the power supply board internal to LED lamp 10. Tip 20 touches a contact in the bottom of the light bulb socket when LED lamp 10 is fully screwed into the socket. The light bulb socket provides electrical connection between tip 20 and the live wire of the AC supply. The contact in the bottom of the light bulb socket is a spring or other mechanism that is conductive and applies force against tip 20 to ensure good electrical connection. Together, threads 18 and tip 20 provide AC power to the power supply board in LED lamp 10 via the light bulb socket connection. LED lamp 10 also works properly when threads 18 and tip 20 are connected to a DC power source.

LED lamp 10 is powered by a utility AC voltage input. In various embodiments of the present invention, 100 volt (V), 110V, 120V, 220V, 240V, and 277V are usable by LED lamp 10. Other voltages, including voltages over 277V are usable in other embodiments. In one embodiment, LED lamp 10 includes an internal switch to operate with either a 120 volt or 277 volt AC supply, which are the two major supply voltages for indoor lighting in the United States. LED lamp 10 automatically configures to either 120 volt mode or 277 volt mode based on the detected AC supply voltage. External dimming mechanisms control the brightness of LED lamp 10 by varying the magnitude of AC power input to the LED lamp. In some embodiments, a terminal on base 12 allows for the connection of a 0-10V dimming signal wire. An internal control mechanism switches LED lamp 10 to 277 volt mode when an input voltage over 135 volts is detected, and retains the LED lamp in 277 volt mode when the input voltage drops below 135 volts to provide smooth dimming.

Heatsink 14 is composed of one or more thermally conductive materials such as copper (Cu), aluminum (Al), or a carbon composite material. Heatsink 14 cools the internal components of LED lamp 10 by absorbing heat generated by the internal components and dissipating the heat into the surrounding air. Heatsink 14 includes a number of fins running longitudinally to provide increased surface area between the heatsink and the surrounding air. Heatsink 14 is thermally connected to the components of the power supply in LED lamp 10 via a mechanical connection between the heatsink and power supply. Additionally, heatsink 14 absorbs heat from the power supply in LED lamp 10 via convection and radiation. Heatsink 14 also provides the internal components of LED lamp 10, including the power supply, with physical support and protection.

Lens 16 is mounted to heatsink 14 using friction coupling, fasteners, adhesive, or another suitable attachment mechanism. Lens 16 is clear or coated with one or more light-diffusing materials. Depending upon the application, lens 16 is transparent, translucent, or frosty and includes polarizing filters, colored filters, or additional lenses such as concave, convex, planar, "bubble," and Fresnel lenses. Lens 16 conditions light emanating from LED lamp 10 so that the light fulfills the intended purpose for using the LED lamp. LED lamp 10 is manufactured with an interchangeable lens 16 to customize characteristics of the light from the LED lamp when the need arises.

The size and shape of heatsink 14 conform to the BR30 standard shape used for flood lights. LED lamp 10 fits for use in most household applications where incandescent flood lights were previously used. In other embodiments, base 12, heatsink 14, and lens 16 are manufactured to fit other standard light bulb sockets and shapes, such as the A19 light bulb used for many household applications. For some uses where retrofitting to a light bulb socket is not necessary, the power supply and light engine of LED lamp 10 are configured to be used without base 12, heatsink 14, and lens 16 (e.g., an automobile instrument panel or lighting integrated into a product).

Figure 1B:
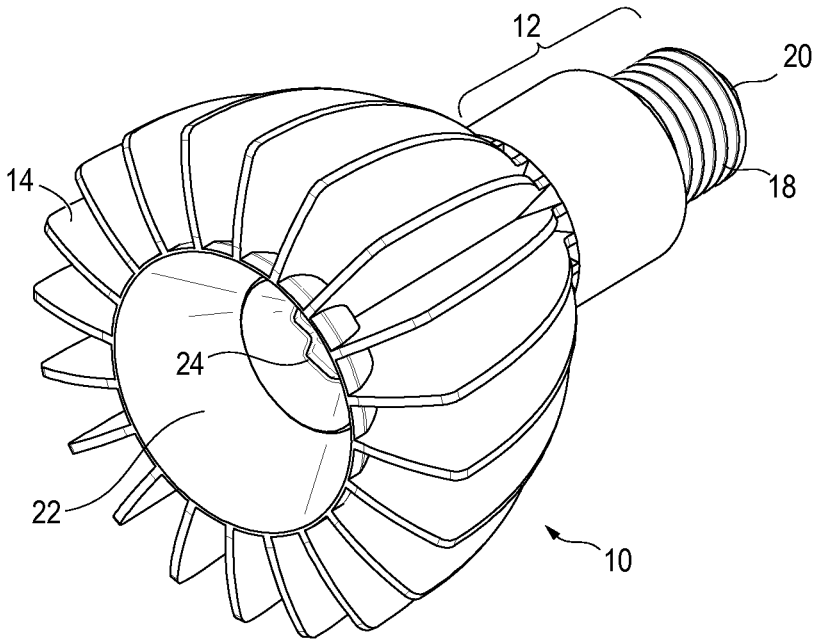

FIG. 1*b* illustrates LED lamp 10 with lens 16 removed to reveal conic reflector 22 and LED emitter or light engine 24. Conic reflector 22 reduces glare and confines light emitted by LED light engine 24 to a desired area. In other embodiments, conic reflector 22 is not used and LED light engine 24 is mounted directly under lens 16. LED light engine 24 includes one or more LEDs mounted on a substrate, and provides the light for LED lamp 10. The substrate of LED light engine 24 routes the electric current from the power supply to the one or more LEDs mounted on the substrate. When the power supply voltage exceeds the minimum threshold for turning on the LEDs of LED light engine 24, current flows through the LED light engine and the LEDs produce light.

LED light engine 24 is mounted on a heat spreader plate within LED lamp 10. A thermally conductive material, such as thermal grease, a thermal interface pad, or a phase change pad, is deposited between LED light engine 24 and the heat spreader plate to improve heat transfer. The heat spreader plate is composed of or includes a thermally conductive material or materials. Heatsink 14 is thermally connected to LED light engine 24 via the heat spreader plate, and heat energy is conducted from the LED light engine to the heatsink via the heat spreader plate.

Figure 2A:
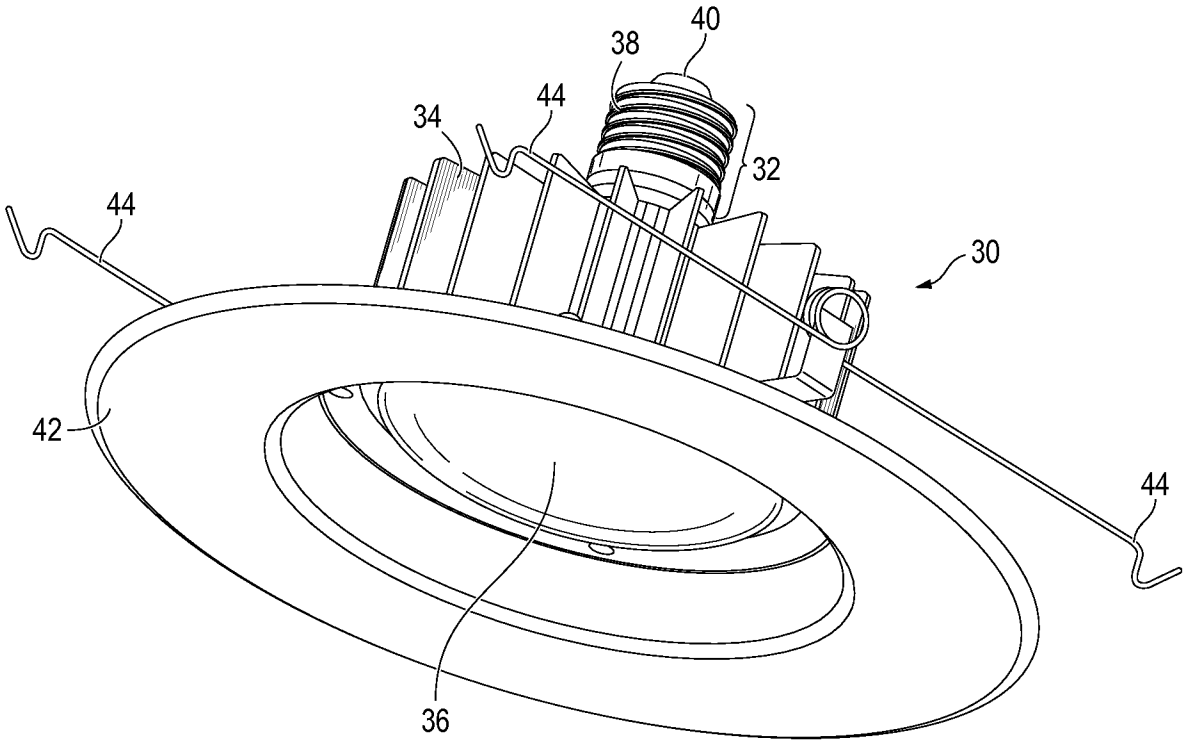
FIGS. 2*a*-2*b* illustrate an LED lamp for use with a recessed can housing.

FIG. 2*a* illustrates an LED lamp 30 for use in recessed lighting. LED lamp 30 includes base 32 mounted to heatsink 34. Lens 36 is mounted to heatsink 34 opposite base 32. LED lamp 30 includes LED light engine 24 installed under lens 36 and facing so that light emanating from the LED light engine travels through the lens. Base 32 is similar to base 12 of LED lamp 10. Heatsink 34 is similar to heatsink 14 of LED lamp 10. Lens 36 is similar to lens 16 of LED lamp 10. Base 32 includes threads 38 and tip 40. LED lamp 30 also includes trim 42 mounted to heatsink 34 using screws or other suitable means. Clips 44 are connected to heatsink 34 or trim 42. Trim 42 includes a flange that, after installation of LED lamp 30 into a recessed can housing, protrudes from the recessed can housing. Heatsink 34 is coupled to trim 42 to facilitate removal of heat energy from the trim.

Figure 2B:
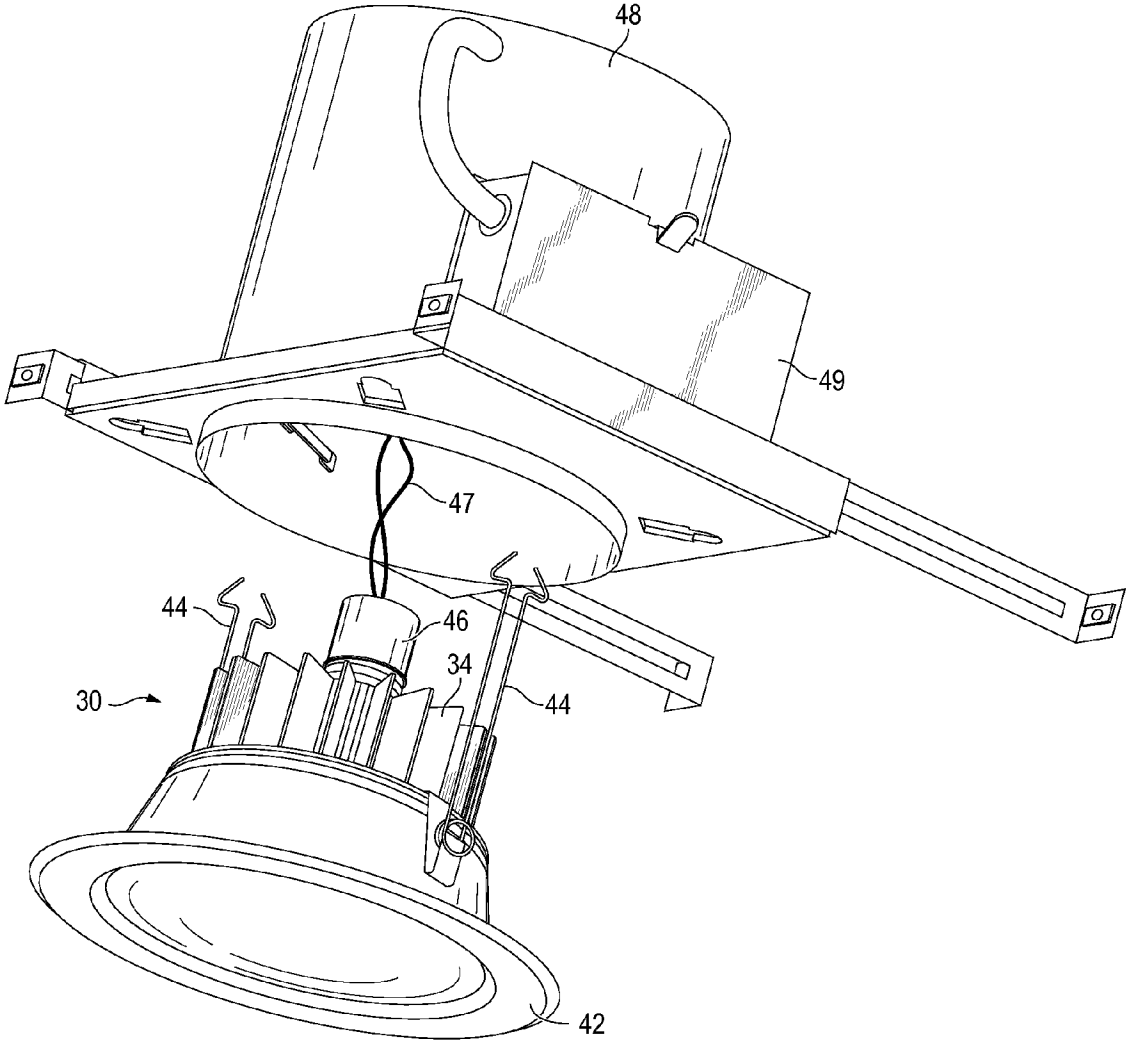

FIG. 2*b* illustrates LED lamp 30 being installed into recessed can housing 48. Recessed can housing 48 is typically installed into a ceiling or other surface where a light source is required. Socket 46 hangs loose on wires 47 within recessed can housing 48 and is screwed onto base 32 to provide AC power to LED lamp 30. Clips 44 are spring loaded. Clips 44 are compressed upward to fit into recessed can housing 48. Once LED lamp 30 is within recessed can housing 48, clips 44 are released and apply pressure to the inside of the recessed can housing. The pressure of clips 44 against recessed can housing 48 holds LED lamp 30 in place via friction. LED lamp 30 is inserted into recessed can housing 48 to the point where trim 42 is against a ceiling or other surface.

Socket 46 is connected to the AC supply by wires 47. Wires 47 allow socket 46 to hang loose within recessed can housing 48. Wires 47 run through recessed can housing 48 to junction box 49, where wires 47 are coupled to wires from the main AC supply. In some embodiments, additional wires 47 are used to couple a dimmer circuit in led lamp 30 to a 0-10V dimmer switch external to recessed can housing 48.

Figure 3A:
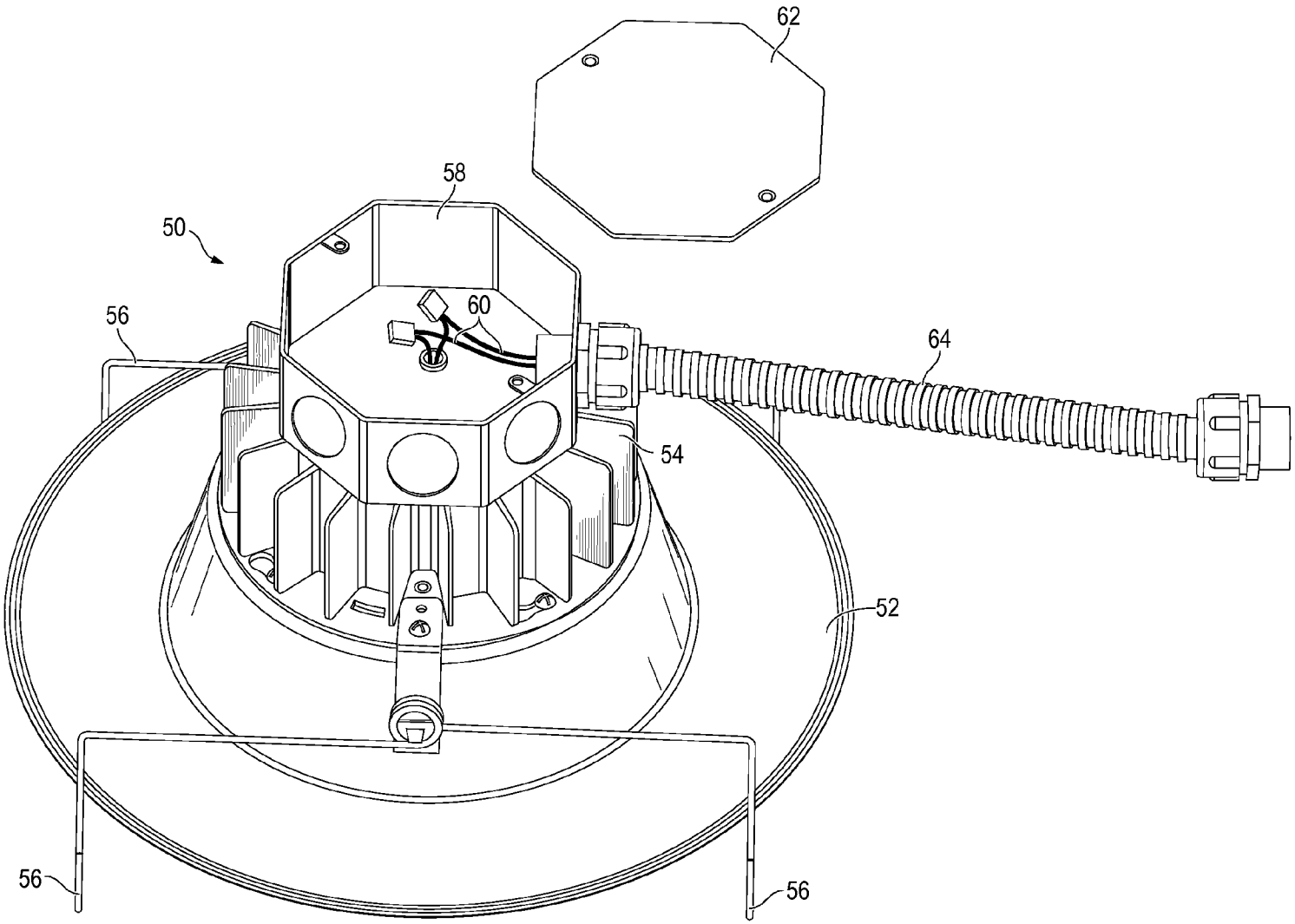
FIGS. 3*a*-3*b* illustrate an LED lamp for use with a ceiling tile.

FIG. 3*a* illustrates LED lamp 50 for mounting within a ceiling. LED lamp 50 includes trim 52 mounted to heatsink 54. Clips 56 are attached to heatsink 54 or trim 52 using a bracket and screw or other suitable means. Junction box 58 is mounted on heatsink 54. Wires 60 provide the AC supply voltage to LED lamp 50. In some embodiments, additional wires 60 are used to transmit a 0-10V dimming signal to LED lamp 50. Junction box cover 62 is installed over junction box 58 once wires 60 are coupled to wires running into LED lamp 50. Electrical conduit 64 is attached to junction box 58. Heatsink 54 is similar to heatsink 34 and heatsink 14. Trim 52 is similar to trim 42. LED lamp 50 includes a lens similar to lens 36 of LED lamp 30, and LED light engine 24 installed under the lens, which are not illustrated.

Clips 56 are spring loaded and compressed upward for installation of LED lamp 50 into a ceiling or ceiling tile. LED lamp 50 also installs into any other surface with a properly sized opening. LED lamp 50 is inserted through the surface opening with electrical conduit 64 inserted first, and then junction box 58 and heatsink 54 follow the electrical conduit through the opening. LED lamp 50 is inserted to the point where trim 52 contacts the ceiling or other surface. Clips 56 are released to apply pressure to the ceiling. Clips 56 apply pressure to the ceiling to squeeze the ceiling between the clips and trim 52. Once LED lamp 50 is installed, wires 60 are guided through electrical conduit 64 and coupled to the wires from the LED lamp. Junction box cover 62 is mounted over junction box 58 using screws, clips, or other suitable means, to protect the coupling of wires 60.

Figure 3B:
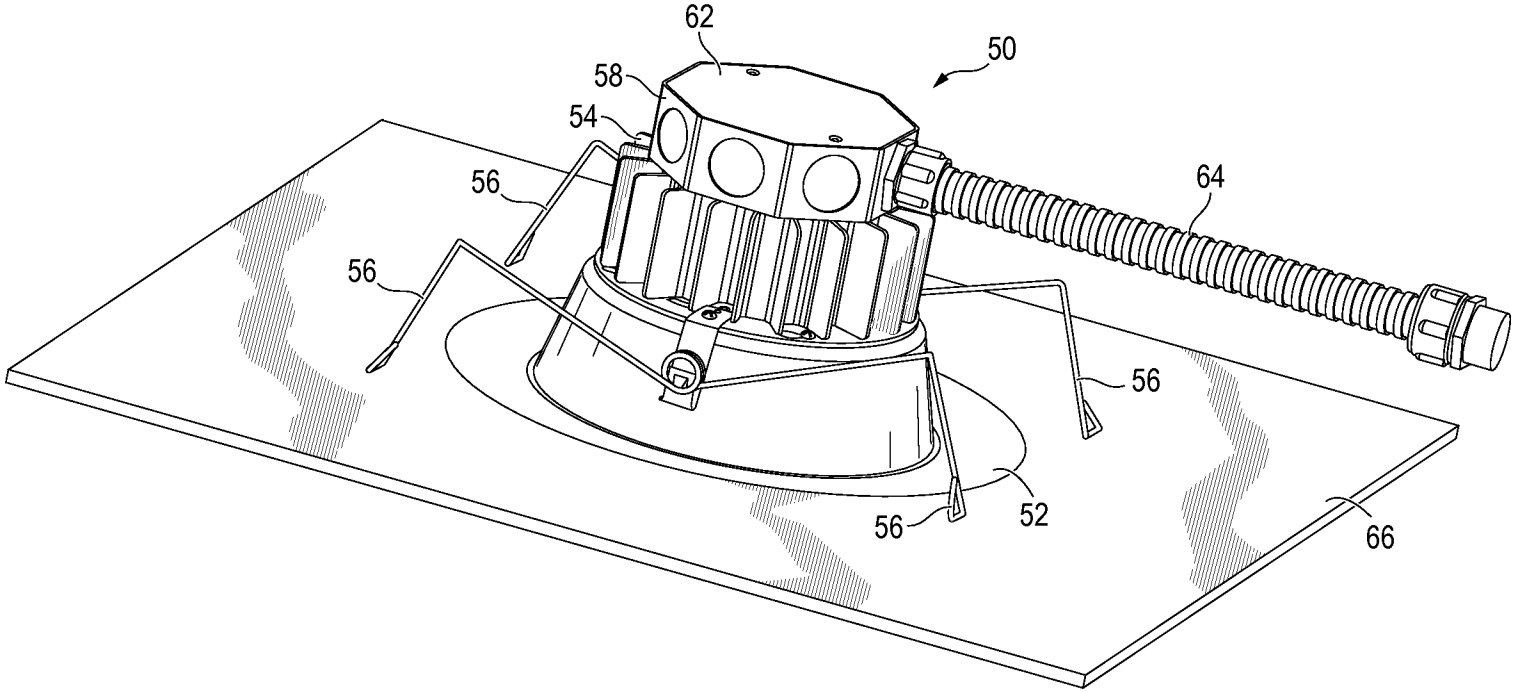

FIG. 3*b* illustrates LED lamp 50 installed in ceiling tile 66. Ceiling tile 66 is disposed between clips 56 and trim 52. Clips 56 apply pressure against ceiling tile 66 and trim 52 to hold LED lamp 50 in place in the ceiling tile. LED lamp 50 is installed in ceiling tile 66 while the ceiling tile is installed in a ceiling, or the ceiling tile is removed for installation of the LED lamp. LED lamp 50 is also installable in a ceiling or other surface without removable tiles.

Figure 4:
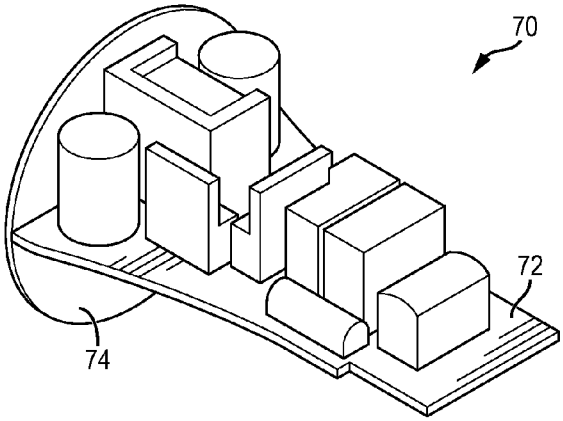
FIG. 4 illustrates a power supply board for an LED lamp.

FIG. 4 illustrates power supply 70 for use in LED lamp 10. LED lamp 30 and LED lamp 50 include power supplies similar to power supply 70, but the power supply is oriented differently depending on the requirements of the specific embodiment. Power supply 70 includes one or more discrete circuit components (e.g., capacitors, inductors, resistors, and transistors) and integrated circuits mounted or formed on circuit board 72. The electrical components on circuit board 72 are electrically connected by traces of the circuit board in order to constitute power supply 70. Details of the electrical components, and the electrical connections between the components, which form power supply 70 are presented below.

Power supply 70 in LED lamp 10 is mounted in base 12 or inside heatsink 14. LED light engine 24 is mounted on heat spreader plate 74. Power supply 70 is connected to an AC supply voltage via threads 18 and tip 20 of base 12. The power supply in LED lamp 30 is connected to an AC supply via threads 38 and tip 40. The power supply in LED lamp 50 is connected to an AC supply via wires 60 running through conduit 64 and junction box 58.

Heat spreader plate 74 is composed of or includes a thermally conductive material or materials. Heat spreader plate 74 is thermally and mechanically connected to heatsink 14. Heatsink 14 is thermally connected to LED light engine 24 via heat spreader plate 74, and heat energy is conducted from the LED light engine to the heatsink via the heat spreader plate.

Power supply 70 provides four key features. First, power supply 70 includes regenerating power source circuitry. The regenerating power source circuitry provides a secondary power tapped from an induction coil which is able to provide power to control circuitry on power supply 70 with very low power consumption. Secondly, power supply 70 accepts any of the various utility voltages used around the globe. In various embodiments, power supply 70 accepts 100V, 110V, 120V, 220V, 240V, or 270V input. Power supply 70 detects and determines the incoming voltage and registers the specific voltage detected as the driver nominal input voltage. Power supply 70 further maintains a power factor greater than 0.9.

Third, power supply 70 accepts a dimmed supply voltage that is at any voltage under 277 volts. After power supply 70 registers the incoming voltage level, the power supply becomes a voltage specific power supply. Power supply 70 remembers the nominal voltage input received, and maintains the voltage configuration when an external dimmer is used to reduce the input voltage temporarily. Power supply 70 is thus compatible with external dimmers, such as wall pack dimmers and other sophisticated dimming systems available on the market. Power supply 70 provides smooth dimming of the light from LED light engine 24. Dimming through reducing the supply voltage is accomplished through forward phase dimming, reverse phase dimming, or sinewave dimming in various embodiments. Power supply 70 may alternatively be operated with a 0-10V light dimming system. Fourth, power supply 70 provides for a non-isolated load. The non-isolated load uses a single coil which allows a high AC to DC conversion efficiency while remaining compact. Fewer parts are needed compared to a power supply with an isolated load.

The circuitry and features of power supply 70 are usable in other situations where AC to DC power conversion is needed. The regenerating power supply circuitry reduces the power consumed by control logic, and is equally effective whether the load of power supply 70 is an LED or another load powered by DC electricity. Power supply 70 provides DC power, including the features of a regenerating power source, universal voltage, dimmable power, and a non-isolated load, to any device. LED light engine 24 is replaced by any desired load.

Figure 5:
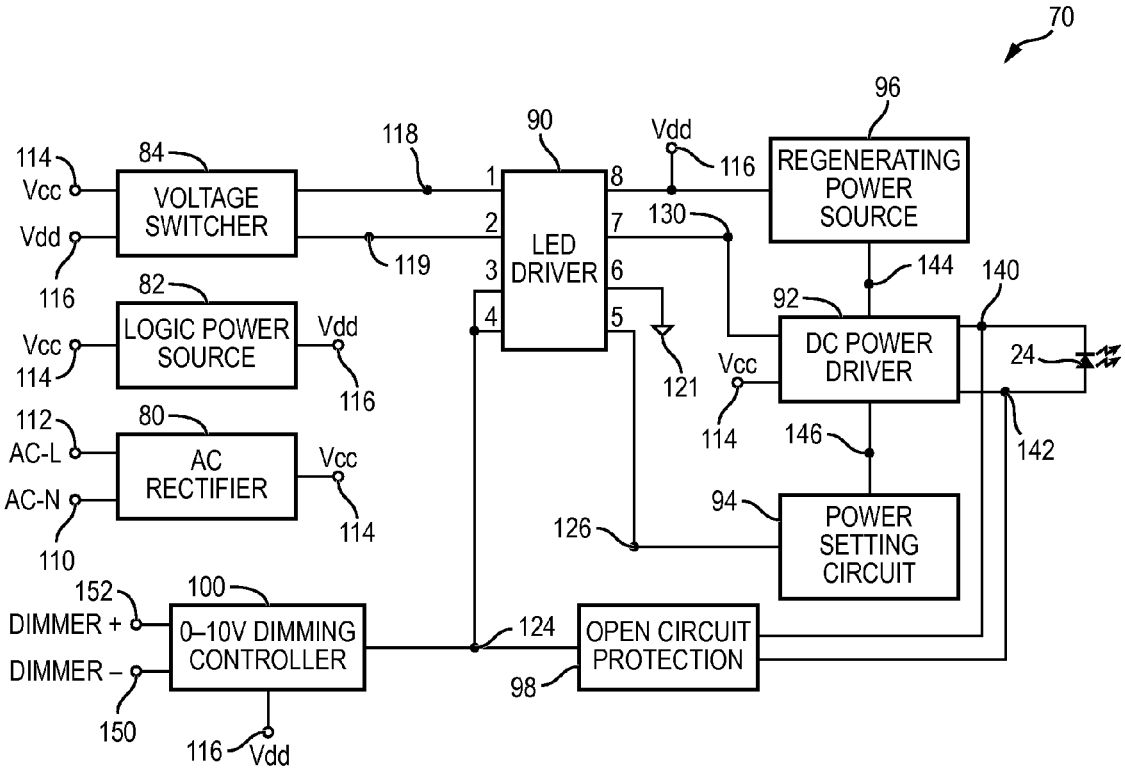
FIG. 5 is a schematic and block diagram of the power supply for the LED lamp.

FIG. 5 illustrates a schematic and block diagram for power supply 70. The major blocks of power supply 70 include AC rectifier 80, logic power source 82, voltage switcher 84, LED driver 90, DC power driver 92, power setting circuit 94, regenerating power source 96, open circuit protection 98, and 0-10V dimming controller 100. LED driver 90 is a controller which regulates the current through LED light engine 24. In the illustrated embodiment, LED driver 90 is an 8-pin integrated circuit (IC) package, part number MLX10803, manufactured by Melexis. The pins of LED driver 90 are also referred to as terminals.

The Melexis IC, part number MLX10803, controls current through LED light engine 24 using a control signal with a fixed off-time and a variable on-time. The on-time, and thus the frequency, of the control signal is adjusted by the Melexis IC to regulate power to LED light engine 24. In another embodiment, a controller IC is used for LED driver 90 which utilizes a fixed frequency control signal. With a fixed frequency control signal, the duty cycle of the control signal is adjusted to regulate power to LED light engine 24. Duty cycle is the ratio between the on-time and off-time of the control signal during each period of the control signal. On-time is increased by the same amount that off-time is decreased to increase the duty cycle while maintaining a substantially constant frequency.

The AC power flowing through threads 18 and tip 20 of base 12 is electrically connected as an input of AC rectifier 80. AC neutral node 110 is electrically connected to the neutral AC supply line via threads 18, and AC live node 112 is electrically connected to the live AC supply line via tip 20. Together, AC neutral node 110 and AC live node 112 provide AC power to AC rectifier 80. AC rectifier 80 rectifies the AC input at AC neutral node 110 and AC live node 112 into a pulsed DC output signal on $V_{CC}$ node 114. $V_{CC}$ node 114 is coupled as an input providing power to logic power source 82, voltage switcher 84, and DC power driver 92. Logic power source 82 accepts $V_{CC}$ node 114 as an input, and outputs a separate DC power signal on $V_{DD}$ node 116. $V_{DD}$ node 116 is coupled to provide power to logic and memory components in voltage switcher 84 and LED driver 90 via pin 8, as well as a reference voltage to dimming controller 100.

Voltage switcher 84 has one output connected to circuit node 118, which is coupled to pin 1 of LED driver 90. LED driver 90 also has an input on pin 2 coupled to voltage switcher 84 via circuit node 119. Pins 3 and 4 of LED driver 90 are both coupled to an output of open circuit protection 98, and an output of dimming controller 100, via circuit node 124. Pin 5 of LED driver 90 is coupled to power setting circuit 94 and pin 6 is coupled to ground node 121. LED driver 90 provides an output on pin 7 coupled to DC power driver 92 via circuit node 130. DC power driver 92 outputs DC power to LED light engine 24 via negative LED node 140 and positive LED node 142. Negative LED node 140 is connected to a negative terminal on LED light engine 24 (i.e., cathode), and positive LED node 142 is connected to a positive terminal on the LED light engine (i.e., anode). DC power driver 92 also has outputs coupled to regenerating power source 96 via circuit node 144 and power setting circuit 94 via circuit node 146. Regenerating power source 96 has an output connected to $V_{DD}$ node 116.

AC rectifier 80 accepts an AC power signal as input on AC neutral node 110 and AC live node 112. AC rectifier 80 accepts 120 volts AC, 277 volts AC, or any AC voltage under 277 volts. 120 volts and 277 volts are the two major supply voltages for indoor lighting in the United States. In some embodiments, power supply 70 is used with either 100V or 200V AC supply voltage, e.g., as provided by a Japanese electric utility. In other embodiments, power supply 70 is used with either 110V or 220V AC supply voltage, e.g., as provided by a Taiwanese electric utility. AC rectifier 80 also accepts a variable AC input voltage. External dimming mechanisms commonly available on the market control the brightness of LED lamp 10 by varying the magnitude of AC input to the LED lamp, and thus AC rectifier 80. In some embodiments, an external dimming mechanism dims LED lamp 10 by cutting off the AC supply signal for a portion of the AC sine wave. When the AC input signal between AC neutral node 110 and AC live node 112 is varied by a dimming mechanism, the pulsed DC signal on $V_{CC}$ node 114 varies to remain approximately proportional to the AC input signal. AC rectifier 80 works properly with a DC input voltage.

AC rectifier 80 contains a full-wave rectifier to convert the input AC power signal on AC neutral node 110 and AC live node 112 to a pulsed DC signal on $V_{CC}$ node 114. An input filter in AC rectifier 80 reduces high frequency components of the input AC supply signal, and reduces high frequency signals generated by power supply 70 flowing back out to the AC supply. AC rectifier 80 contains capacitors connected between $V_{CC}$ node 114 and ground node 121 to filter the pulsed DC signal.

Logic power source 82 has $V_{CC}$ node 114 as an input, and generates a DC signal on $V_{DD}$ node 116. Logic power source 82 includes a capacitor to filter the pulsed DC signal on $V_{CC}$ node 114 into a steady DC voltage on $V_{DD}$ node 116. A Zener diode in logic power source 82 regulates the voltage level at $V_{DD}$ node 116. $V_{DD}$ node 116 provides a DC voltage level usable by integrated circuits and other memory or logic devices. Logic power source 82 contains a transistor which controls whether the logic power source couples $V_{CC}$ node 114 to $V_{DD}$ node 116 to provide power to the $V_{DD}$ node. The transistor in logic power source 82 disconnects $V_{DD}$ node 116 from being powered by $V_{CC}$ node 114 when regenerating power source 96 is supplying sufficient voltage on the $V_{DD}$ node.

Voltage switcher 84 detects the AC input voltage supplied to AC rectifier 80 by sensing the voltage level on $V_{CC}$ node 114, which is a similar signal to the AC input at AC neutral node 110 and AC live node 112 but with positive voltages when the input AC includes negative voltages. When voltage switcher 84 detects the AC input voltage is greater than 135 volts, the voltage switcher uses outputs to pin 1 and pin 2 of LED driver 90 to change the operating mode of the LED driver from 120 volt to 277 volt operating mode. If LED lamp 10 is operating in 277 volt mode, and the AC input voltage falls below 135 volts, voltage switcher 84 retains LED driver 90 in 277 volt mode.

Voltage switcher 84 accepts $V_{CC}$ node 114 and $V_{DD}$ node 116 as inputs, and has outputs coupled to pin 1 of LED driver 90 via circuit node 118 and pin 2 via circuit node 119. When the AC input to AC rectifier 80 reaches a level over 135 volts, a latch in voltage switcher 84 is enabled. The latch in voltage switcher 84 turns on a transistor in the voltage switcher. The transistor in voltage switcher 84 allows current to flow from circuit node 119 to ground node 121 through an additional resistor in the voltage switcher. The value of the resistor is chosen to lower the total resistance between pin 2 of LED driver 90 and ground node 121 to change the internal oscillator frequency of the LED driver. The latch in voltage switcher 84 also recalibrates the input to pin 1 of LED driver 90. The voltage change on pins 1 and 2 of LED driver 90 when the latch in voltage switcher 84 is enabled reconfigures the LED driver from 120 volt operation to 277 volt operation. The latch in voltage switcher 84 causes 277 volt mode to remain enabled when the AC input to AC rectifier 80 falls below 135 volts. When the AC supply signal input to LED lamp 10 is dimmed above and then below 135 volts, the LED lamp dims smoothly because 277 volt mode is maintained by the latch in voltage switcher 84. Power supply 70 with voltage switcher 84 enables LED lamp 10 to be used with external wall pack dimmers or other sophisticated dimming systems available on the market. Voltage switcher 84 delivers smooth dimming of the light from LED light engine 24.

Voltage switcher 84 also includes phase angle controlling circuitry to improve the power factor of power supply 70. The phase angle controlling circuitry of voltage switcher 84 provides power supply 70 with a power factor greater than 0.9. The power factor is raised by improving the alignment between current usage by power supply 70 and the instantaneous voltage level from the AC supply lines 110-112. The output from voltage switcher 84 to pin 1 of LED driver 90 via circuit node 118 controls the amount of current that the LED driver allows to flow through LED light engine 24. Voltage switcher 84 outputs a voltage signal to pin 1 of LED driver 90 that is approximately proportional to the voltage at $V_{CC}$ node 114. $V_{CC}$ node 114 carries a signal that is similar to the signal of the AC supply, with the $V_{CC}$ node signal rectified to have positive values when the AC supply has negative values. By controlling the current used by LED light engine 24 to be approximately proportional to the input AC voltage, the power factor is improved. Controlling the current used by LED light engine 24 to be approximately proportional to the input AC voltage also dims LED lamp 10 when the input AC supply signal is dimmed.

LED driver 90 uses pin 7 as an output to control current through LED light engine 24 via DC power driver 92. LED driver 90 switches a voltage on pin 7 on and off rapidly to regulate the current through LED light engine 24. When LED driver 90 outputs a voltage on pin 7, current flows through an inductor in DC power driver 92. As the current through the inductor rises, the inductor stores energy magnetically. LED driver 90 detects the current flow through the inductor in DC power driver 92 via feedback through power setting circuit 94 and pin 5 of the LED driver. When LED driver 90 detects that current through the inductor in DC power driver 92 has reached an upper threshold, the LED driver turns off voltage at pin 7 to stop increasing the current.

When LED driver 90 removes the voltage from pin 7, the inductor in DC power driver 92 releases the stored energy into LED light engine 24 via negative LED node 140 and positive LED node 142. The current threshold at which LED driver 90 turns off the voltage on pin 7 is controlled by the voltage on input pin 1 of the LED driver. LED driver 90 turns the voltage on pin 7 back on when a certain amount of time has elapsed. The time period LED driver 90 waits after shutting off voltage at pin 7 before applying the voltage to pin 7 again is determined by the resistance between circuit node 119 (i.e., pin 2 of LED driver 90) and ground node 121, which sets the internal clock frequency of the LED driver.

Pin 8 and pin 6 of LED driver 90 are power and ground inputs to the LED driver, respectively. Pin 8 receives power from $V_{DD}$ node 116, and pin 6 is coupled to ground node 121. Pins 3 and 4 of LED driver 90 are inputs that limit the current through the inductor in DC power driver 92, and consequently limit the current through LED light engine 24. Reducing the voltage level at either of pin 3 or pin 4 of LED driver 90 reduces the time that pin 7 to DC power driver 92 is on, and reduces the current through LED light engine 24. Pin 2 controls the internal oscillator frequency in LED driver 90. Pin 1 of LED driver 90 controls the operating range of current through the inductor in DC power driver 92. LED driver 90 will shut off voltage on pin 7 when the voltage on pin 5 reaches 20% of the voltage on pin 1. Therefore, current through LED light engine 24 is accurately controlled by properly setting the voltage at pin 1, and properly configuring a resistor network in power setting circuit 94.

DC power driver 92 takes a switching input from pin 7 of LED driver 90 via circuit node 130, and outputs DC power to LED light engine 24 via negative LED node 140 and positive LED node 142. DC power driver 92 also outputs a high frequency power signal to regenerating power source 96 via circuit node 144. The load on power supply 70, i.e., LED light engine 24, is non-isolated. The non-isolation of the load is due to an inductor in DC power driver 92 with a single coil. The single coil of the inductor in DC power driver 92 is electrically connected to the voltage source and the load. A non-isolated load allows power supply 70 to be manufactured cheaper and more compact because a smaller inductor with a single coil is used, and fewer components are required. The non-isolated load also provides a more efficient conversion of AC power to DC.

DC power driver 92 outputs a current to power setting circuit 94 via circuit node 146. The inductor of DC power driver 92 is connected in series with a transistor between $V_{CC}$ node 114 and circuit node 146 to power setting circuit 94. When the transistor in DC power driver 92 is turned on by pin 7 of LED driver 90, current flows through the inductor of the DC power driver and to power setting circuit 94 via circuit node 146. When the transistor in DC power driver 92 is turned off, no current flows through circuit node 146 to power setting circuit 94. Current through the inductor instead flows through LED light engine 24.

Pin 7 of LED driver 90 controls the state of the transistor in DC power driver 92. When DC power driver 92 receives a voltage from pin 7 of LED driver 90, the transistor is turned on and current flows from $V_{CC}$ node 114, through the inductor in DC power driver 92, through the transistor, and to power setting circuit 94 via circuit node 146. The inductor in DC power driver 92 stores energy magnetically as current through the inductor rises. When LED driver 90 detects a threshold current has been reached flowing through the inductor, voltage at pin 7 is turned off by the LED driver. When LED driver 90 shuts off voltage at pin 7, the transistor in DC power driver 92 shuts off. DC power driver 92 causes the energy stored magnetically in the inductor to discharge through LED light engine 24 when the transistor is shut off. DC power driver 92 contains a capacitor to filter the power to LED light engine 24 into a more level DC signal. The capacitor in DC power driver 92 charges when the inductor is discharging through LED light engine 24, and discharges to power the LED light engine when the inductor is recharging. The charging and discharging of the capacitor in DC power driver 92 creates a smoother voltage signal at positive LED node 142, and thus smoother light emitted by LED light engine 24.

Power setting circuit 94 provides a feedback mechanism allowing LED driver 90 to detect the amount of current through the inductor in DC power driver 92. Current flowing through the inductor in DC power driver 92 flows through power setting circuit 94 via circuit node 146. Power setting circuit 94 provides a path to ground node 121 for the current through the inductor in DC power driver 92. A configurable resistor network in power setting circuit 94 controls the ratio of current through the inductor in DC power driver 92 and voltage at circuit node 126, i.e., pin 5 of LED driver 90. LED driver 90 shuts off current through the inductor in DC power driver 92 when voltage on pin 5 reaches a threshold. Lowering the total resistance for current through power setting circuit 94 causes the voltage at pin 5 to be lower for a given current. Put another way, lowering the effective resistance of the resistor network in power setting circuit 94 means the current through the inductor in DC power driver 92 reaches a higher value before the voltage threshold on pin 5 of LED driver 90 is reached.

Configuring the resistor network in power setting circuit 94 sets the power setting of LED lamp 10. For instance, LED lamp 10 includes settings for 6 watt, 8 watt, 10 watt, or any other desired power setting. There are multiple methods for configuring the resistor network of power setting circuit 94. In one embodiment, a jumper array or dual in-line package (DIP) switches are provided on circuit board 72 to manually configure the resistor network. A number of resistors correlate to the jumpers or DIP switches and are added to or removed from the circuit to attain the appropriate resistance to ground node 121. In another case, an integrated circuit adds resistors to the circuit, or removes resistors, by controlling transistors connected in series with the resistors. When an integrated circuit configures the resistor network, $V_{DD}$ node 116 powers the integrated circuit. The advantage of using an integrated circuit to control the resistor network of power setting circuit 94 is that the power setting is controlled remotely. In some embodiments, a variable resistor is provided that is manually adjusted by an end user.

Regenerating power source 96 receives a high frequency power signal on circuit node 144, which is connected to the output of the inductor in DC power driver 92. Circuit node 144 carries a power signal which is at a higher frequency than the AC power on AC neutral node 110 and AC live node 112. The frequency of the power signal at circuit node 144 is controlled by the frequency at which LED driver 90 switches the output at pin 7 to control DC power driver 92. Regenerating power source 96 converts the high frequency power signal at circuit node 144 into DC, and outputs the DC signal as a second source for $V_{DD}$ node 116 along with logic power source 82. When regenerating power source 96 is operational, $V_{DD}$ node 116 is provided power by the regenerating power source. A transistor in logic power source 82 decouples the logic power source from providing power to $V_{DD}$ node 116 when regenerating power source 96 is operational.

Because of the higher frequency of the power signal input to regenerating power source 96 compared to AC rectifier 80, the regenerating power source provides power to the logic and memory components of power supply 70 at a higher efficiency than AC rectifier 80 and logic power source 82. Regenerating power source 96 provides a secondary power tapped from an inductor or induction coil in DC power driver 92 able to provide power to LED driver 90 with very low power consumption, which boosts the overall AC to DC conversion efficiency of power supply 70. Regenerating power source 96 raises the overall efficiency of LED lamp 10, giving the LED lamp an efficiency close to 90 percent, i.e., close to 90% of the power consumed by the LED lamp is output as visible light.

Regenerating power source 96 improves the efficiency at which power supply 70 provides power to LED driver 90. While the power consumption of LED light engine 24 can be modified to modify the brightness of LED lamp 10, the power consumption of LED driver 90 is approximately static. Moreover, as LEDs that operate more efficiently are developed, the power consumption of LED driver 90 is not reduced. Accordingly, when LED lamp 10 is configured or set to a lower power consumption level, the power savings due to regenerating power source 96 has a greater effect on the overall power consumption of the LED lamp. Regenerating power source 96 more significantly impacts the overall conversion efficiency of power supply 70 at the lower power range of LED light engine 24.

Open circuit protection 98 operates as a safety mechanism for LED lamp 10. Open circuit protection 98 includes an optocoupler that the open circuit protection turns on when the voltage difference between negative LED node 140 and positive LED node 142 (i.e., the voltage across the terminals of LED light engine 24) becomes greater than the expected voltage across the LEDs. A higher than expected voltage between negative LED node 140 and positive LED node 142 indicates a problem with LED light engine 24 is limiting current flowing through the LED light engine. When the optocoupler in open circuit protection 98 is turned on, the open circuit protection connects pins 3 and 4 of LED driver 90 to ground node 121 via an output at circuit node 124. Pins 3 and 4 of LED driver 90 set a threshold current level for when the LED driver disables current increasing through the inductor in DC power driver 92. When pin 3 or pin 4 of LED driver 90 is near ground potential, the inductor current threshold that the LED driver uses is set low. Current is enabled by LED driver 90 for only a short period, and operation of DC power driver 92 is essentially disabled. Disabling DC power driver 92 when LED light engine 24 is malfunctioning or disconnected reduces power consumption by power supply 70 attempting to power the LED light engine, and reduces the possibility of a malfunction causing further damage to LED lamp 10.

Dimming controller 100 is also coupled to pins 3 and 4 of LED driver 90. Dimming controller 100 receives a dimmer voltage signal which is calibrated between 0 volts and 10 volts (0-10V). Dimmer− signal 150 is a reference or ground voltage, and dimmer+ signal 152 varies from 0-10V relative to the dimmer− signal. When dimmer+ signal 152 is at 10V, LED driver 90 powers LED light engine 24 at full power. When dimmer+ signal 152 is at 0V, LED driver 90 powers LED light engine 24 at minimal power. Dimming controller 100 reorients the 0-10V signal at dimmer+ signal 152 to vary from 0V to $V_{DD}$ at circuit node 124. As the signal at dimmer+ signal 152 moves between 0 and 10 volts, the signal at circuit node 124 moves substantially proportionally between 0 and $V_{DD}$. Dimming controller 100 controls the power output of LED driver 90 in a similar manner to open circuit protection 98. However, open circuit protection 98 is either on or off while dimming controller 100 allows for analog control of the voltage at input pins 3 and 4 of LED driver 90.

Figure 6:
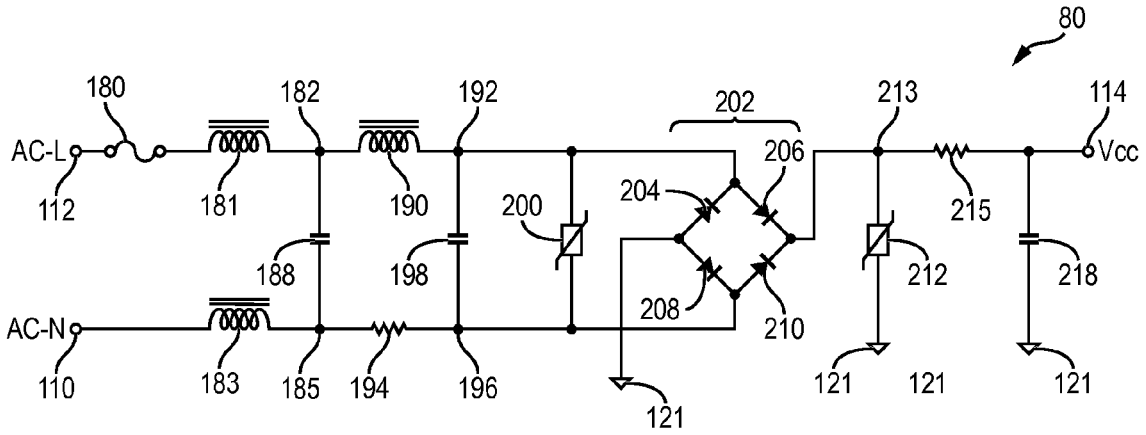
FIG. 6 is a schematic diagram of the AC rectifier for the power supply.

FIG. 6 is a schematic diagram of AC rectifier 80. AC rectifier 80 receives an AC input signal at AC neutral node 110 and AC live node 112. AC rectifier 80 outputs a pulsed DC power signal at $V_{CC}$ node 114 which is approximately proportional to the AC input but with positive voltages when the AC input has negative voltages. Fuse 180 is coupled between AC live node 112 and inductor 181. Inductor 181 is coupled between fuse 180 and circuit node 182. Inductor 183 is coupled between AC neutral line 110 and circuit node 185. Capacitor 188 is coupled between circuit node 182 and circuit node 185. Inductor 190 is coupled between circuit nodes 182 and 192. Resistor 194 is coupled between circuit node 185 and circuit node 196. Capacitor 198, metal-oxide varistor (MOV) 200, and full-wave rectifier 202 are coupled in parallel between circuit nodes 192 and 196. Full-wave rectifier 202 includes diode 204, diode 206, diode 208, and diode 210. The anode of diode 204 is coupled to ground node 121, and the cathode of diode 204 is coupled to circuit node 192. The anode of diode 206 is coupled to circuit node 192, and the cathode of diode 206 is coupled to circuit node 213. The anode of diode 208 is coupled to ground node 121, and the cathode of diode 208 is coupled to circuit node 196. The anode of diode 210 is coupled to circuit node 196, and the cathode of diode 210 is coupled to circuit node 213. MOV 212 is coupled between circuit node 213 and ground node 121. Resistor 215 is coupled between circuit node 213 and $V_{CC}$ node 114. Capacitor 218 is coupled between $V_{CC}$ node 114 and ground node 121.

AC rectifier 80 accepts a 120 volt AC supply voltage or a 277 volt AC supply voltage connected to AC neutral node 110 and AC live node 112. Other voltages are accepted in other embodiments. External dimming mechanisms vary the magnitude of AC input to LED lamp 10, or otherwise modify the AC signal, which is coupled to AC neutral node 110 and AC live node 112. AC rectifier 80 is able to handle any AC input voltage under 277 volts and outputs a pulsed DC signal to $V_{CC}$ node 114 that is approximately proportional to the AC input. In some embodiments, voltages over 277V are used. The output of AC rectifier 80 on $V_{CC}$ node 114 is approximately the same as the AC input when the AC input has a positive voltage, and is approximately the inverse of the AC input when the AC input has a negative voltage. Therefore, the pulsed DC on $V_{CC}$ node 114 has positive voltage values and a frequency of 120 Hertz (Hz) if the input AC frequency is 60 Hz.

AC rectifier 80 accepts a DC power source as input as well as AC power sources. If LED lamp 10 is connected to a DC power source, AC rectifier 80 and the LED lamp work properly. If the input to power supply 70 is a pulsed DC signal, the signal at $V_{CC}$ node 114 will be a similar pulsed DC signal. If the input to power supply 70 is a steady DC signal, the signal at $V_{CC}$ node 114 will be a steady DC signal.

Fuse 180 is coupled to disconnect AC live node 112 from power supply 70, and provides safety in the event that a component of the power supply malfunctions resulting in a short circuit. A filament in fuse 180 melts if power supply 70 draws more current than the power supply uses under normal operating scenarios, effectively creating an open circuit in the fuse and cutting off AC power to the power supply. If a component of power supply 70 becomes a short circuit, the component will draw more current than intended and fuse 180 will become an open circuit, disconnecting AC live node 112 from power supply 70. Without the use of fuse 180, power supply 70 draws potentially unlimited current when a component is short circuited. Fuse 180 disconnects AC power to power supply 70 before any component of the power supply draws an unsafe amount of current.

Inductors 181 and 183 seal condition EMI generated by power supply 70. Capacitor 188, inductor 190, resistor 194, and capacitor 198 form an input filter for AC rectifier 80. The input filter allows frequencies near the 50-60 Hz range, i.e., common household AC frequencies, to pass to full-wave rectifier 202 with little effect. The input filter reduces the magnitude of higher frequency signals commonly generated by switching power supplies. The AC supply contains high frequency components generated by other devices coupled to the AC supply, which cause interference in power supply 70 if not properly filtered. The input filter also reduces high frequency signals generated by power supply 70 propagating out to the AC supply through AC neutral node 110 and AC live node 112, thus reducing interference in other devices connected to the same AC supply.

MOV 200 provides protection from power surges on the AC supply coupled to AC neutral node 110 and AC live node 112. MOV 200 exhibits a resistance that is a function of the voltage across MOV 200. When the AC voltage input from AC neutral node 110 and AC live node 112 is within the normal operating bounds of power supply 70, MOV 200 is approximately an open circuit between circuit nodes 192 and 196. When the AC voltage at AC neutral node 110 and AC live node 112 surges sufficiently above normal voltage levels, the resistance of MOV 200 reduces to divert current from AC live node 112 to AC neutral node 110 through MOV 200. MOV 200 draws enough current to lower the AC voltage between circuit nodes 192 and 196 back to a normal range for power supply 70. Without MOV 200, power surges on AC live node 112 result in a voltage on $V_{CC}$ node 114 that is higher than expected. The increase in voltage on $V_{CC}$ node 114 results in components of power supply 70 experiencing voltage outside of specified voltage tolerances, potentially resulting in malfunction of the power supply.

In electronic circuits, diodes generally operate as one-way valves, allowing current to flow from anode to cathode, but blocking current from cathode to anode. Diodes have a turn-on voltage, which if exceeded turns the diode on so that current flows from anode to cathode. When the anode voltage exceeds the cathode voltage by the turn-on voltage, a diode is said to be forward biased. When forward biased, the diode operates as an approximate short circuit. When the voltage at the cathode of a diode exceeds the voltage at the anode, the diode is said to be reverse biased. When reverse biased, a diode operates as an approximate open circuit.

Full-wave rectifier 202 converts the AC input power at AC neutral node 110 and AC live node 112, which alternates between positive and negative voltages, into a pulsed DC signal that has positive voltages. During the positive portion of the AC cycle, the voltage at circuit node 192 is higher than the voltage at circuit node 196. Full-wave rectifier 202 connects the higher voltage at circuit node 192 to $V_{CC}$ node 114 through resistor 215, and the lower voltage at circuit node 196 to ground node 121. Diode 206 is forward biased and allows current to flow from circuit node 192 to $V_{CC}$ node 114, providing positive voltage to the $V_{CC}$ node. Diode 208 is forward biased and allows current to flow from ground node 121 to the neutral AC line at AC neutral node 110, which completes the circuit between $V_{CC}$ node 114 and ground node 121. Diode 204 is reverse biased and blocks the higher voltage at circuit node 192 from flowing directly to ground node 121. Diode 210 is reverse biased and blocks the positive voltage on $V_{CC}$ node 114 from flowing to the neutral AC line at AC neutral node 110.

During the negative portion of the AC cycle, the voltage at circuit node 192 is lower than the voltage at circuit node 196. Circuit node 192 and circuit node 196 have switched voltage polarities, and the diodes of full-wave rectifier 202 have switched operating modes. Full-wave rectifier 202 connects the higher voltage at circuit node 196 to $V_{CC}$ node 114, and the lower voltage at circuit node 192 to ground node 121. Diode 210 is forward biased and allows current to flow from circuit node 196 to $V_{CC}$ node 114 through resistor 215, providing positive voltage to the $V_{CC}$ node. Diode 204 is forward biased and allows current to flow from ground node 121 to the live AC line at AC live node 112, which completes the circuit from $V_{CC}$ node 114 to ground node 121. Diode 208 is reverse biased, and blocks the higher voltage at circuit node 196 from flowing directly to ground node 121. Diode 206 is reverse biased, and blocks the positive voltage on $V_{CC}$ node 114 from flowing to the live AC line at AC live node 112.

Full-wave rectifier 202 operates properly if a DC signal is applied to AC neutral node 110 and AC live node 112. When a positive DC power signal is present on AC live node 112, diodes 206 and 208 remain forward biased to complete the circuit between $V_{CC}$ node 114 and ground node 121, and diodes 204 and 210 are reverse biased. If a positive DC power signal is present on AC neutral node 110 relative to AC live node 112, diodes 210 and 204 are forward biased, while diodes 206 and 208 remain reverse biased.

MOV 212 serves a similar function and operates similarly to MOV 200. If the voltage on $V_{CC}$ node 114 is sufficiently higher than normal for operation of power supply 70, MOV 212 connects the $V_{CC}$ node to ground node 121. When $V_{CC}$ node 114 is too high, MOV 200 draws enough current to ground node 121 to lower the $V_{CC}$ node voltage back to within an acceptable range. Capacitor 218 provides additional filtering for the power signal on $V_{CC}$ node 114.

Figure 7A:
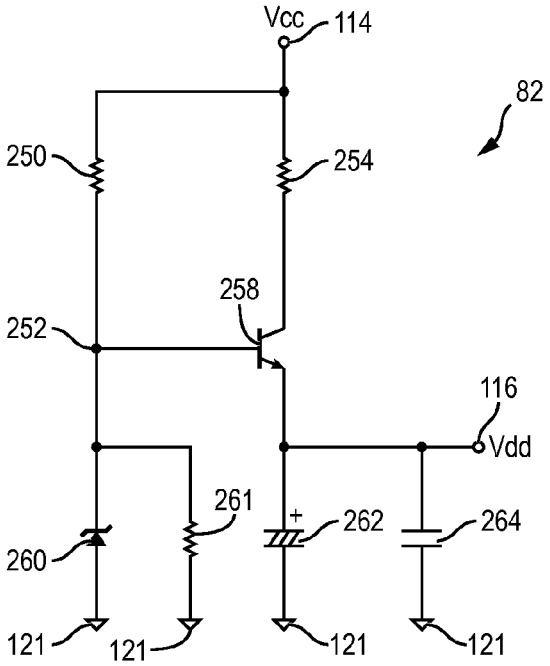
FIGS. 7*a*-7*b* are schematic diagrams of the logic power source for the power supply.

FIG. 7*a* is a schematic diagram of logic power source 82. Logic power source 82 has $V_{CC}$ node 114 as an input, and outputs a DC voltage on $V_{DD}$ node 116. Resistor 250 is coupled between $V_{CC}$ node 114 and circuit node 252. Resistor 254 is coupled between $V_{CC}$ node 114 and the collector of NPN bipolar junction transistor (BJT) 258. BJT 258 has a collector coupled to resistor 254, a base coupled to circuit node 252, and an emitter coupled to $V_{DD}$ node 116. Zener diode 260 has an anode coupled to ground node 121 and a cathode coupled to circuit node 252. Resistor 261 is coupled in parallel with Zener diode 260 between circuit node 252 and ground node 121. Polar capacitor 262 has a negative terminal coupled to ground node 121 and a positive terminal coupled to $V_{DD}$ node 116. Capacitor 264 is coupled between $V_{DD}$ node 116 and ground node 121.

Zener diodes are designed to allow current to flow from cathode to anode when a positive voltage exceeding the Zener diode breakdown voltage is applied to the cathode relative to the anode. When the breakdown voltage of a Zener diode is exceeded, current flows from cathode to anode. Current from cathode to anode is the reverse of normal diode operation. Zener diodes maintain the voltage difference from cathode to anode at approximately the Zener diode breakdown voltage for a wide range of reverse currents, making Zener diodes useful for maintaining a circuit node at a desired voltage level.

Zener diode 260 limits the voltage at circuit node 252, i.e., the base of BJT 258, to a known value. During the portion of the $V_{CC}$ node 114 pulse phase when the voltage of the $V_{CC}$ node is greater than the breakdown voltage of Zener diode 260, the Zener diode limits the voltage at circuit node 252 to the breakdown voltage. Current flows through Zener diode 260 from circuit node 252 to ground node 121. Resistor 261 provides a known load to Zener diode 260 and improves the stability of the voltage at circuit node 252.

The voltage at circuit node 252 will remain at approximately the breakdown voltage of Zener diode 260 as long as the voltage at $V_{CC}$ node 114 is greater than the breakdown voltage. With current flowing through Zener diode 260, the voltage level at circuit node 252 is approximately constant. The current through resistor 250 is dependent on the voltage at $V_{CC}$ node 114 and the value of resistor 250. Specifically, the current through resistor 250 is the difference between the voltages at $V_{CC}$ node 114 and circuit node 252 divided by the value of resistor 250. A portion of the current through resistor 250 supplies the base current to BJT 258, and the remainder of the current through resistor 250 flows through Zener diode 260 and resistor 261 to ground node 121. While the amplitude of the signal at $V_{CC}$ node 114 varies by the use of an external dimming mechanism, the DC voltage level of $V_{DD}$ node 116 remains approximately constant by the use of Zener diode 260.

Bipolar junction transistors (BJTs) generally include three connection terminals. The base of a BJT is a control terminal. The emitter and collector of a BJT are conduction terminals. The base of a BJT generally controls current between the emitter and collector. A BJT can be used as a switch. The state of a BJT is either on or off when used as a switch. When an NPN BJT is turned on, current flows from the collector terminal to the emitter terminal of the BJT. Current in a PNP BJT that is turned on flows from emitter to collector. A BJT that is off substantially blocks current flowing from collector to emitter and from emitter to collector. The state of a BJT is controlled by the BJT's base terminal. If a voltage at the base terminal of an NPN BJT is greater than a voltage at the emitter terminal by at least the NPN BJT's turn-on voltage, than the NPN BJT is turned on. If a voltage at the emitter terminal of a PNP BJT is greater than a voltage at the base terminal by at least the PNP BJT's turn-on voltage, than the PNP BJT is turned on.

BJT 258 controls the flow of current from $V_{CC}$ node 114 through resistor 254 to $V_{DD}$ node 116. Current flows from the collector to the emitter of BJT 258 when a positive voltage at circuit node 252 (i.e., the base of BJT 258) relative to $V_{DD}$ node 116 (i.e., the emitter of BJT 258) is greater than the turn-on voltage of BJT 258. The turn-on voltage is usually about 650 millivolts for silicon BJTs at room temperature but can be different depending on the type of transistor and the biasing of the transistor.

Capacitors 262 and 264 filter the pulsed DC signal from $V_{CC}$ node 114. Capacitors 262 and 264 hold a charge to limit the amount by which the voltage level of $V_{DD}$ node 116 is reduced when the AC signal powering the $V_{DD}$ node is below the voltage level of the $V_{DD}$ node.

When LED lamp 10 is turned on for the first time, capacitors 262 and 264 are not charged and $V_{DD}$ node 116 is at approximately the same voltage as ground node 121. Upon applying an AC signal to power supply 70, $V_{CC}$ node 114 rises to a positive voltage. Voltage at circuit node 252 rises with $V_{CC}$ node 114 up to the breakdown voltage of Zener diode 260. The voltage at the base of BJT 258 (i.e., circuit node 252) is greater than the voltage at the emitter of BJT 258, which is at approximately ground potential, by more than the turn-on voltage of BJT 258. BJT 258 turns on and current flows through the BJT from $V_{CC}$ node 114 to $V_{DD}$ node 116, charging capacitors 262 and 264. As capacitors 262 and 264 charge, the voltage level at $V_{DD}$ node 116 rises to nearly the breakdown voltage of Zener diode 260. $V_{DD}$ node 116 provides power to the logic and memory circuits of power supply 70, and LED lamp 10 turns on. BJT 258 turns off when the voltage at the emitter of BJT 258 rises to close to the same voltage as circuit node 252, i.e., the Zener diode breakdown voltage, because the emitter and base of 258 are at approximately the same voltage level. Once power supply 70 is on, regenerating power source 96 provides power to $V_{DD}$ node 116. BJT 258 does not turn back on, and logic power source 82 does not provide power to $V_{DD}$ node 116, as long as regenerating power source 96 maintains $V_{DD}$ node 116 at or above the breakdown voltage of Zener diode 260. BJT 258 turns back on when the voltage level at $V_{DD}$ node 116 falls below the breakdown voltage of Zener diode 260, and $V_{CC}$ node 114 provides power to $V_{DD}$ node 116 through resistor 254 and BJT 258.

Figure 7B:
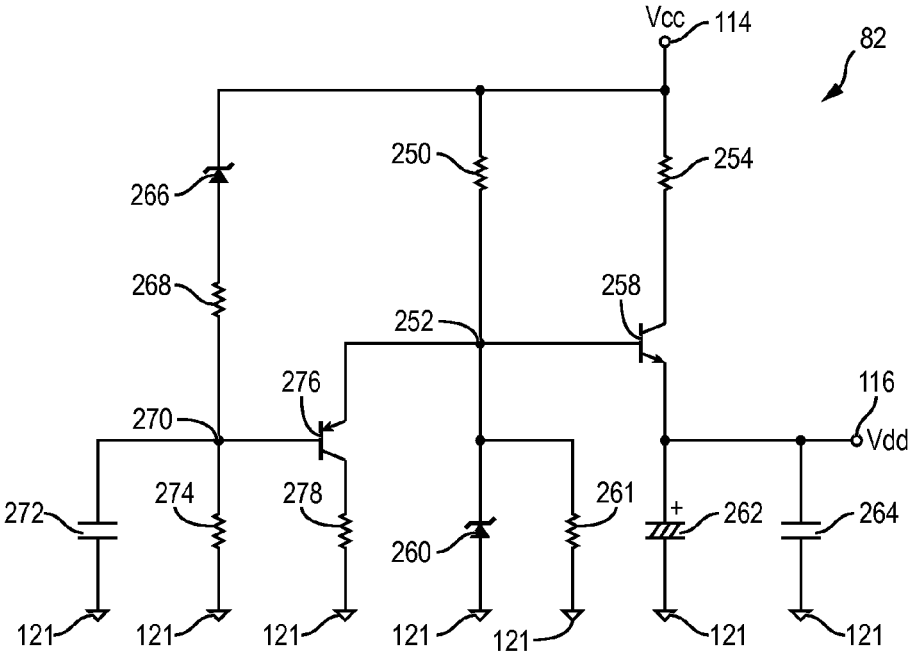

FIG. 7*b* illustrates an alternative embodiment for logic power source 82. Logic power source 82 in FIG. 7*b* includes the complete circuit from FIG. 7*a*, with the addition of the following components. Zener diode 266 includes a cathode coupled to $V_{CC}$ node 114. Resistor 268 is coupled between an anode of Zener diode 266 and circuit node 270. Capacitor 272 and resistor 274 are coupled in parallel between circuit node 270 and ground node 121. PNP BJT 276 includes an emitter coupled to circuit node 252, a base coupled to circuit node 270, and a collector coupled to resistor 278. Resistor 278 is coupled between the collector of BJT 276 and ground node 121.

Figure 8:
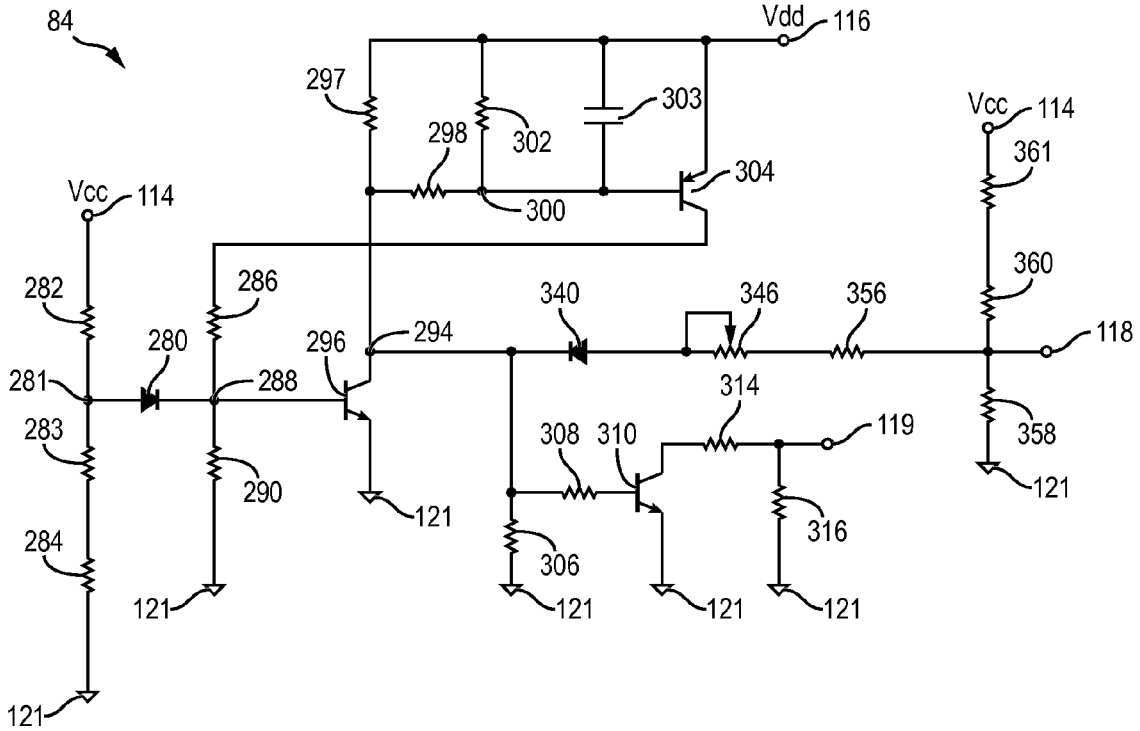
FIG. 8 is a schematic diagram of the voltage switcher for the power supply.

FIG. 8 is a schematic of voltage switcher 84. Voltage switcher 84 has $V_{CC}$ node 114 and $V_{DD}$ node 116 as inputs, and outputs signals to pin 1 of LED driver 90 via circuit node 118 and pin 2 via circuit node 119 to configure the LED driver into either 120 volt or 277 volt mode. Diode 280 has an anode coupled to $V_{CC}$ node 114 via a voltage divider consisting of resistors 282, 283, and 284. A cathode of diode 280 is coupled to circuit node 288. Resistor 282 is coupled between $V_{CC}$ node 114 and circuit node 281 at the anode of diode 280. Resistors 283 and 284 are coupled in series between circuit node 281 and ground node 121. Resistor 286 is coupled between circuit node 288 and a collector of BJT 304. Resistor 290 is coupled between circuit node 288 and ground node 121. NPN BJT 296 has a base coupled to circuit node 288, an emitter coupled to ground node 121, and a collector coupled to circuit node 294. Resistor 297 is coupled between circuit node 294 and $V_{DD}$ node 116. Resistor 298 is coupled between circuit node 294 and circuit node 300. Resistor 302 and capacitor 303 are coupled in parallel between circuit node 300 and $V_{DD}$ node 116. PNP BJT 304 has a base coupled to circuit node 300, an emitter coupled to $V_{DD}$ node 116, and a collector coupled to circuit node 288 through resistor 286. Resistor 306 is coupled between circuit node 294 and ground node 121. Resistor 308 is coupled between circuit node 294 and the base of NPN BJT 310. BJT 310 has a base coupled to resistor 308, an emitter coupled to ground node 121, and a collector coupled to resistor 314. Resistor 314 is coupled between the collector of BJT 310 and circuit node 119. Resistor 316 is coupled between circuit node 119 and ground node 121.

The phase angle controlling circuitry of voltage switcher 84 is coupled between circuit node 294 and circuit node 118. Diode 340 includes a cathode coupled to circuit node 294 and an anode coupled to variable resistor or potentiometer 346. In embodiments where a potentiometer is used, potentiometer 346 includes a wiper terminal coupled to the anode of diode 340 or to resistor 356. Resistor 356 is coupled between potentiometer 346 and circuit node 118. Resistor 358 is coupled between circuit node 118 and ground node 121. Resistors 360 and 361 are coupled in series between $V_{CC}$ node 114 and circuit node 118. Resistors 358, 360, and 361 form a voltage divider between $V_{CC}$ node 114 and ground node 121 to keep the voltage at circuit node 118 approximately proportional to the voltage at $V_{CC}$ node 114.

Resistors 282, 283, and 284 operate as a voltage divider to reduce the voltage of $V_{CC}$ node 114 used by voltage switcher 84. Resistors 282, 283, 284, and 290 form a network and are selected so that the voltage at circuit node 288 reaches the turn-on voltage of BJT 296 when the voltage at $V_{CC}$ node 114 indicates an AC input voltage to power supply 70 of over 135 volts. Diode 280 operates as a blocking diode. When the pulsed DC signal of $V_{CC}$ node 114 causes the voltage at circuit node 281 to be greater than the voltage level at circuit node 288 plus the turn-on voltage of diode 280, diode 280 is forward biased and allows current to flow to circuit node 288. When the voltage level at circuit node 281 falls below the voltage level at circuit node 288, diode 280 is reverse biased and substantially blocks current from flowing back out to $V_{CC}$ node 114.

Bipolar junction transistors (BJTs) generally include three connection terminals. The base of a BJT is a control terminal. The emitter and collector of a BJT are conduction terminals. The base of a BJT controls current between the emitter and collector. A BJT can be a switch. The state of a BJT is either on or off when used as a switch. When an NPN BJT is turned on, current flows from the collector terminal to the emitter terminal of the BJT. Current in a PNP BJT that is turned on flows from emitter to collector. A BJT that is off substantially blocks current flowing from collector to emitter and from emitter to collector. The state of a BJT is controlled by the BJT's base terminal. If a voltage at the base terminal of an NPN BJT is greater than a voltage at the emitter terminal by at least the NPN BJT's turn-on voltage, than the NPN BJT is turned on. If a voltage at the emitter terminal of a PNP BJT is greater than a voltage at the base terminal by at least the PNP BJT's turn-on voltage, then the PNP BJT is turned on.

Resistor 286 and resistor 290 form a voltage divider. A voltage divider is two resistors in series between two different voltage levels, which generate a third voltage level at a circuit node between the two resistors. The voltage between the two resistors is a function of the value of the two resistors. If two resistors with resistance values of R1 and R2 are coupled in series with R1 coupled to a voltage source, Vin, and R2 coupled to ground potential, the function to determine the voltage at the node between the two resistors is (R2*Vin)/(R1+R2). If the two resistors have the same value, the voltage between the two resistors will be approximately halfway between the first two voltage levels. Changing the ratio of the resistors in a voltage divider causes the voltage between the two resistors to shift.

With BJT 296 turned off, only a small current flows from $V_{DD}$ node 116 through resistors 297, 298, and 302. Without significant current flowing through resistors 297, 298, and 302, the resistors provide only a small voltage differential, and the voltage at circuit node 294 is at or near the voltage of $V_{DD}$ node 116. Circuit node 300 and the collector of BJT 296 are at approximately the same voltage level as $V_{DD}$ node 116. Therefore, the emitter of BJT 304 ($V_{DD}$ node 116) is at approximately the same voltage potential as the base of BJT 304 (circuit node 300), and BJT 304 is turned off. BJT 304 substantially blocks current flowing from $V_{DD}$ node 116 to circuit node 288.

The base of BJT 310 is coupled to circuit node 294, which is near the voltage of $V_{DD}$ node 116, while the emitter of BJT 310 is coupled to ground node 121. Therefore, the base-emitter junction of BJT 310 is forward biased, and BJT 310 is turned on. Current flows through resistor 314 to ground node 121. As long as BJT 296 and BJT 304 are off, the voltage at circuit node 294 stays near the voltage at $V_{DD}$ node 116, and BJT 310 remains turned on.

Once the AC voltage input to power supply 70 reaches 135 volts, the voltage at circuit node 288 is sufficient to turn on BJT 296. Circuit node 294 is coupled to ground node 121 via BJT 296. The additional current flowing through resistor 302 results in a voltage differential, and circuit node 300 drops to a voltage sufficient to turn on BJT 304. In addition, with circuit node 294 at approximately ground potential, BJT 310 is off and resistor 314 is not coupled to ground node 121 through BJT 310.

BJT 296 turns on when the input AC voltage to power supply 70 is above 135 volts AC. Current flows from the collector of BJT 296 to the emitter of BJT 296. The current through BJT 296 flows from $V_{DD}$ node 116 via resistors 297, 298, and 302, creating a voltage differential between the $V_{DD}$ node, circuit node 300, and the collector of BJT 296. Circuit node 294 is connected to ground node 121 through BJT 296, and is at approximately ground potential. When BJT 296 is on, resistor 302 and resistor 298 form a voltage divider between $V_{DD}$ node 116 and ground node 121 via BJT 296. The ratio of the values of resistor 302 and resistor 298 is selected such that when BJT 296 is turned on, the voltage potential at circuit node 300 is sufficiently low to turn on BJT 304.

With BJT 304 turned on, current flows from the emitter of BJT 304 ($V_{DD}$ node 116) to the collector of BJT 304 (circuit node 288 via resistor 286). The current through BJT 304 feeds back to circuit node 288 via resistor 286. The current flowing from $V_{DD}$ node 116 through a turned on BJT 304, resistor 286, and to circuit node 288 creates a latch between BJT 304 and BJT 296. When the AC input to power supply 70 falls below the 135 volt threshold required to turn on BJT 296, BJT 296 remains turned on because of the current flowing from $V_{DD}$ node 116 through resistor 286. If an external dimming mechanism reduces the AC input voltage below 135 volts, the latch formed between BJT 296 and BJT 304 keeps BJT 310 turned off and LED lamp 10 remains in 277 volt mode. BJT 296 keeps BJT 304 turned on via the current flowing from $V_{DD}$ node 116 through resistors 298 and 302. BJT 304 keeps BJT 296 turned on via the current flowing from $V_{DD}$ node 116 through BJT 304 and resistor 286. As long as $V_{DD}$ node 116 has a sufficient voltage to keep BJT 304 and BJT 296 turned on, the latch remains set and configures LED driver 90 for 277 volt mode. LED lamp 10 returns to 120 volt operating mode when the voltage level at $V_{DD}$ node 116 falls to a level insufficient to keep BJT 296 and BJT 304 latched.

BJT 296 and BJT 304 control the state of BJT 310. When BJT 296 is on, voltage at the base of BJT 310 is approximately ground level. Ground potential at the base of BJT 310 is insufficient to turn on BJT 310 because the emitter is also coupled to ground node 121. When BJT 310 is off, resistor 314 is not coupled between circuit node 119 and ground node 121, and the resistance between at circuit node 119 and ground node 121 is approximately equal to the resistance of resistor 316.

With BJT 296 turned off, circuit node 294 is not coupled to ground node 121 through BJT 296. Circuit node 294 is at approximately the same voltage as $V_{DD}$ node 116 because of the connection through resistors 297, 298, and 302. The resistance between circuit node 119 and ground node 121 is approximately equal to the parallel resistance of resistors 314 and 316. Circuit node 119 is coupled to pin 2 of LED driver 90. The total resistance between pin 2 of LED driver 90 and ground node 121 controls the frequency of the internal oscillator of the LED driver, which in turn controls the amount of time that the control signal to DC power driver 92 remains off each cycle.

Voltage switcher 84 provides a smooth dimming for LED lamp 10 when used with a 277 volt AC supply. When a 277 volt supply line input to power supply 70 is dimmed below 120 volts, dimming occurs smoothly because LED driver 90 is retained in 277 volt mode. Power supply 70 with voltage switcher 84 is compatible with external dimmer wall packs and other sophisticated dimming systems available on the market.

Resistor 358 and resistors 360-361 form a voltage divider between $V_{CC}$ node 114 and ground node 121. The voltage divider provides a signal at circuit node 118 that is approximately proportional to the signal at $V_{CC}$ node 114, but at a reduced voltage level. Circuit node 118 is coupled to pin 1 of LED driver 90. Resistor 358 and resistors 360-361 are selected to provide a signal at circuit node 118 that is at a voltage potential acceptable as an input to LED driver 90.

$V_{CC}$ node 114 carries a signal that is similar to the AC signal input on AC neutral node 110 and AC live node 112, with the $V_{CC}$ node rectified to include positive voltage potentials when the AC live node includes negative voltage potentials. Therefore, the signal at circuit node 118 is similar to the AC input to power supply 70 with negative voltages rectified to positive voltages, and the voltage level reduced by the voltage divider of resistors 358, 360, and 361. Circuit node 118 is coupled to pin 1 of LED driver 90, so that pin 1 has a signal that is approximately proportional to the AC input signal of power supply 70.

Pin 1 of LED driver 90 controls the amount of current which the LED driver allows to flow through LED light engine 24. Providing a signal to pin 1 of LED driver 90 that is approximately proportional to the AC voltage input causes the LED driver to power LED light engine 24 with current that is approximately proportional to the AC input voltage. Power factor is a measurement of the phase difference between the AC supply voltage and the current used by a device. The highest power factor, 1.0, is achieved when current used by a device is perfectly in phase with the AC supply voltage. By controlling the current through LED light engine 24 with a signal that is approximately proportional to the AC supply voltage, a high power factor is achieved. Current through LED light engine 24 which is proportional to the AC supply voltage also provides dimming capability for LED lamp 10 by dimming the AC input to power supply 70.

Resistor 356, potentiometer 346, and diode 340 couple circuit node 118 back to circuit node 294. The connection from the latch of BJT 296 and BJT 304 to circuit node 118 causes the voltage setting of voltage switcher 84 to have an effect at pin 1 of LED driver 90. Potentiometer 346 modifies the magnitude by which the value of circuit node 294 affects circuit node 118. In one embodiment, potentiometer 346 is disposed on circuit board 72 and accessible by a consumer.

Figure 9:
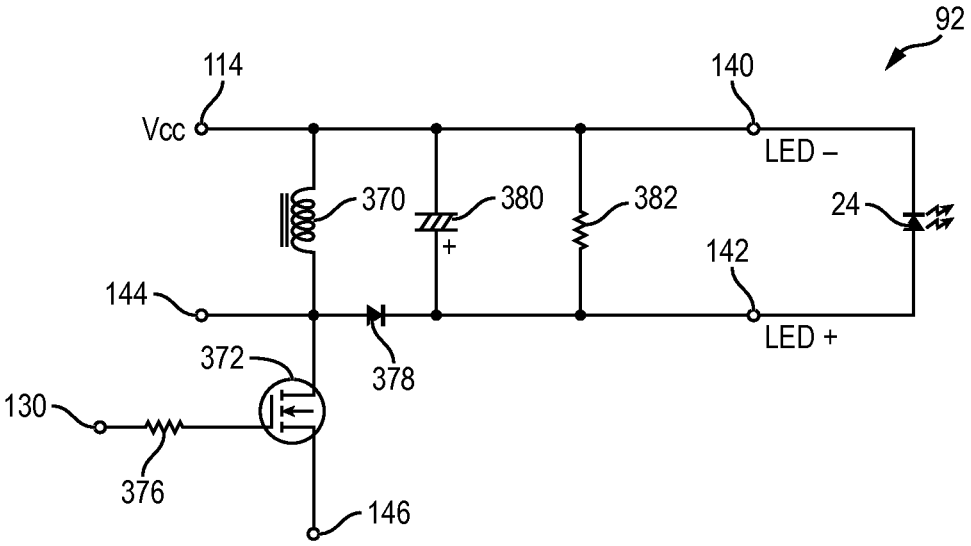
FIG. 9 is a schematic diagram of the DC power driver for the power supply.

FIG. 9 is a schematic of DC power driver 92. DC power driver 92 includes $V_{CC}$ node 114 as a power input, and circuit node 130 coupled to LED driver 90 as a control input. Inductor 370 is coupled between $V_{CC}$ node 114 and circuit node 144. Circuit node 144 is an output of DC power driver 92 coupled to regenerating power source 96. Metal-oxide-semiconductor field-effect transistor (MOSFET) 372 includes a drain terminal coupled to circuit node 144, a gate terminal coupled to resistor 376, and a source terminal coupled to circuit node 146. Circuit node 146 is an output of DC power driver 92 coupled to power setting circuit 94. Resistor 376 is coupled between circuit node 130 and the gate of MOSFET 372. Diode 378 has an anode coupled to circuit node 144 and a cathode coupled to positive LED node 142. DC power driver 92 couples $V_{CC}$ node 114 to negative LED node 140. Capacitor 380 and resistor 382 are coupled in parallel between negative LED node 140 and positive LED node 142. Capacitor 380 is a polar capacitor with a negative terminal coupled to negative LED node 140 and a positive terminal coupled to positive LED node 142.

Circuit node 130 is an input to DC power driver 92 coupled to the gate of MOSFET 372 via resistor 376. Circuit node 130 is coupled to pin 7 of LED driver 90. LED driver 90 switches a voltage at circuit node 130 between on and off to control MOSFET 372. MOSFETs generally include 3 terminals. The gate of a MOSFET is a control terminal, while the drain and source are conduction terminals. A voltage on the gate of a MOSFET controls current between the drain and source. When LED driver 90 applies a voltage to the gate of MOSFET 372, a channel is created in the MOSFET allowing current to flow from circuit node 144 to circuit node 146. When MOSFET 372 is initially turned on, the current level rises from $V_{CC}$ node 114, through inductor 370 and MOSFET 372, and to ground node 121 via circuit node 146 and power setting circuit 94. As current through inductor 370 rises, the inductor stores energy magnetically, i.e., the inductor is charged.

When LED driver 90 detects that the current through inductor 370 has reached a threshold value, the LED driver stops supplying voltage to the gate of MOSFET 372 via pin 7 and circuit node 130. The channel through MOSFET 372 between circuit node 144 and circuit node 146 closes, and the MOSFET substantially blocks current from flowing between circuit node 144 and circuit node 146. Current continues to flow through inductor 370, but with the path to ground node 121 through MOSFET 372 blocked. The energy stored in inductor 370 discharges to create a positive voltage at circuit node 144 relative to $V_{CC}$ node 114. The positive voltage at circuit node 144 forward biases diode 378, and current flows through diode 378 to positive LED node 142. The current through diode 378 to positive LED node 142 powers LED light engine 24, and also charges capacitor 380.

LED driver 90 switches the voltage to the gate of MOSFET 372 back on after a certain period of time. The period of time LED driver 90 waits is set by the resistance coupled between pin 2 of the LED driver and ground node 121, which controls the internal oscillator frequency of the LED driver. The time period to wait before turning MOSFET 372 back on is different between the 120V and 277V settings of voltage switcher 84, depending on if resistor 314 is added in parallel with resistor 316. The voltage at the gate of MOSFET 372 re-enables the channel through the MOSFET allowing current to flow from circuit node 144 to circuit node 146. Circuit node 144 is again coupled to ground node 121 via circuit node 146 and power setting circuit 94. Current again increases from $V_{CC}$ node 114, through inductor 370 and MOSFET 372, and to ground node 121 via circuit node 146 and power setting circuit 94. As the current through inductor 370 rises, the inductor again stores energy magnetically.

During the period when MOSFET 372 is switched on by LED driver 90, the voltage at circuit node 144 will be at a lower voltage potential than $V_{CC}$ node 114 due to the connection to ground node 121 through MOSFET 372 and power setting circuit 94. Capacitor 380 retains a charge and provide current to power LED light engine 24 during the period when inductor 370 is storing energy. Current flows from $V_{CC}$ node 114 to charge inductor 370. When MOSFET 372 is switched off by LED driver 90, the current through inductor 370 has no path to ground node 121 and instead discharges through diode 378 to power LED light engine 24 and charge capacitor 380.

Inductor 370 provides for a non-isolated load to power supply 70. The voltage source, i.e., $V_{CC}$ node 114, and the load, i.e., LED light engine 24, are connected to a single coil of inductor 370. When MOSFET 372 is turned on, the single coil of inductor 370 stores energy magnetically. When MOSFET 372 is turned off, the single coil of inductor 370 discharges the stored energy through LED light engine 24. A non-isolated load enables a cheaper and more compact power supply 70 because a smaller inductor 370 with a single coil is used, and fewer components are required. The non-isolated load also improves conversion efficiency from AC power to DC power.

Figure 10:
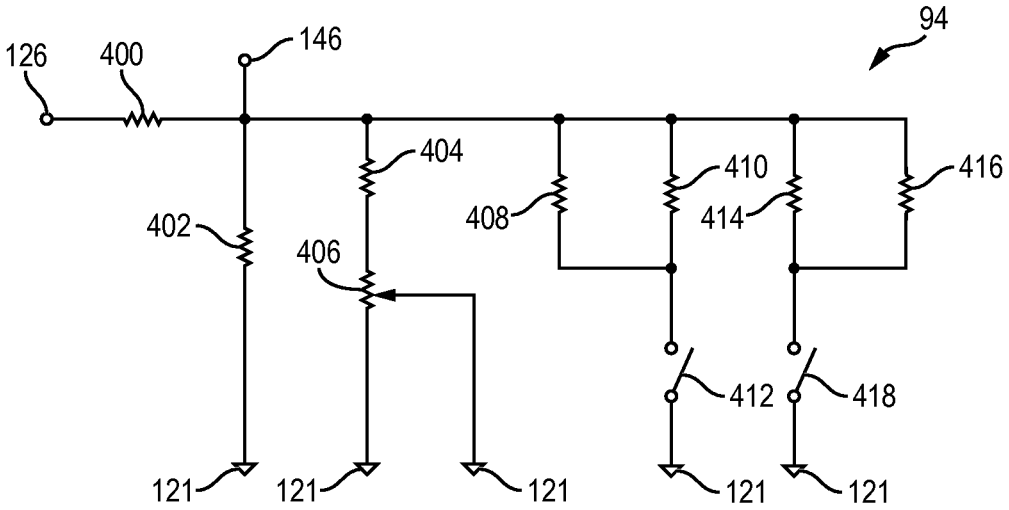
FIG. 10 is a schematic diagram of the power setting circuit for the power supply.

FIG. 10 is a schematic of power setting circuit 94. Circuit node 146 is an input to power setting circuit 94 from DC power driver 92. Circuit node 126 is an output of power setting circuit 94 to pin 5 of LED driver 90. Resistor 400 is coupled between circuit node 126 and circuit node 146. Resistor 402 is coupled between circuit node 146 and ground node 121. Resistor 404 and potentiometer 406 are coupled in series between circuit node 146 and ground node 121. Resistor 408 and resistor 410 are coupled in parallel between circuit node 146 and switch 412, which is further coupled to ground node 121. Resistor 414 and resistor 416 are coupled in parallel between circuit node 146 and switch 418, which is further coupled to ground node 121.

Power setting circuit 94 provides a configurable path to ground node 121 for current flowing through inductor 370 in DC power driver 92. As current flows through power setting circuit 94 from circuit node 146 to ground node 121, a differential voltage is observed at circuit node 126. Circuit node 126 is coupled to pin 5 of LED driver 90, and used by the LED driver to sense the current through inductor 370. Power setting circuit 94 is configurable to control the resistance between circuit node 146 and ground node 121. The effective resistance of power setting circuit 94 determines the ratio of current through inductor 370 to voltage at circuit node 126. Because LED driver 90 shuts off voltage to MOSFET 372 in DC power driver 92 when the voltage at circuit node 126 reaches a threshold, modifying the resistor network of power setting circuit 94 changes the current through inductor 370 at which the voltage threshold is reached. The peak current through inductor 370 controls the current through LED light engine 24, and the total power output of LED lamp 10.

Switches 412 and 418 are DIP switches or a jumper array mounted on circuit board 72. While two switches are illustrated, any number of switches can be used to provide the desired number of power settings for LED lamp 10. Switches 412 and 418 are accessible by a consumer using LED lamp 10 so that the power output of the LED lamp can be modified, e.g., from 40 watt to 60 watt equivalent, without having to return the bulb to a store. In addition, a store can stock and sell a bulb with multiple power settings without having to stock a separate SKU for every differently powered bulb.

Switches 412 and 418 configure the resistor network of power setting circuit 94. Switch 412 controls whether resistors 408 and 410 are coupled between circuit node 146 and ground node 121. Switch 418 controls whether resistors 414 and 416 are coupled between circuit node 146 and ground node 121. Switches 412 and 418 are binary on-off switches, and can be operated in four possible configurations to provide the required resistance for the desired power mode of LED lamp 10. The number of power settings possible is controlled by the number of switches. For N switches, 2^N different power settings are possible. In some embodiments, electronic switches, such as BJTs or MOSFETs, are used instead of switches 412 and 418. The BJTs allow a semiconductor device to change the power setting of power supply 70, e.g., in response to an infrared or other remote control. Potentiometer 406 acts as a trim or bias setting, and can be modified by an end user to adjust every power setting higher or lower together.

Figure 11:
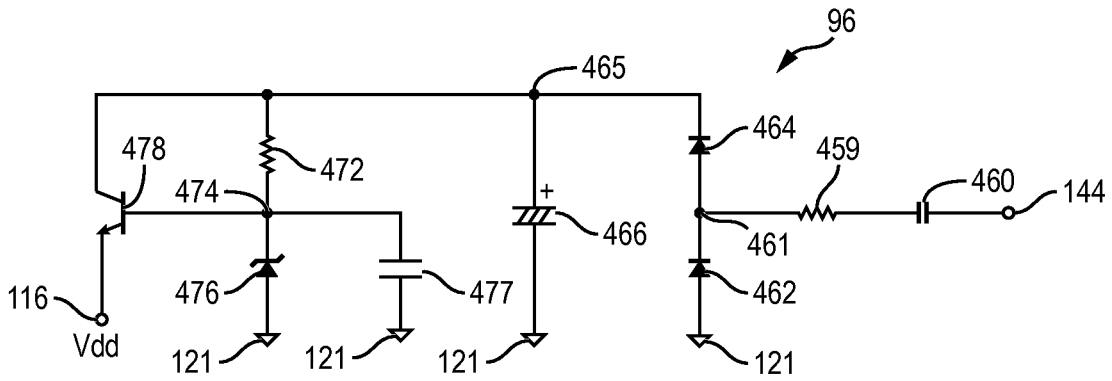
FIG. 11 is a schematic diagram of the regenerating power source for the power supply.

FIG. 11 is a schematic of regenerating power source 96. Regenerating power source 96 receives a high frequency power signal on circuit node 144 as an input and outputs a DC power signal on $V_{DD}$ node 116. Resistor 459 and capacitor 460 are coupled in series between circuit node 144 and circuit node 461. Diode 462 has an anode coupled to ground node 121 and a cathode coupled to circuit node 461. Diode 464 has an anode coupled to circuit node 461 and a cathode coupled to circuit node 465. Polar capacitor 466 has a negative terminal coupled to ground node 121 and a positive terminal coupled to circuit node 465. Resistor 472 is coupled between circuit node 465 and circuit node 474. Zener diode 476 has an anode coupled to ground node 121 and a cathode coupled to circuit node 474. Capacitor 477 is coupled between circuit node 474 and ground node 121 in parallel with Zener diode 476. NPN BJT 478 has a collector coupled to circuit node 465, a base coupled to circuit node 474, and an emitter coupled to $V_{DD}$ node 116.

The signal on circuit node 144 is coupled from DC power driver 92. Circuit node 144 is at a lower voltage level than $V_{CC}$ node 114 when MOSFET 372 of DC power driver 92 is on and inductor 370 is storing energy. Circuit node 144 is at a higher voltage level than $V_{CC}$ node 114 when MOSFET 372 is off and inductor 370 is discharging to LED light engine 24. The rapid switching between MOSFET 372 being on and MOSFET 372 being off creates the high frequency power signal on circuit node 144.

Capacitor 460 operates as a coupling capacitor between circuit node 144 and circuit node 461. Capacitor 460 passes the AC component of the signal on circuit node 144 to circuit node 461 while isolating regenerating power source 96 from a DC offset of circuit node 144.

Diode 462 operates as a clamping diode. If the AC signal at circuit node 461 is at a voltage level below ground node 121, diode 462 allows capacitor 460 to charge back up to ground potential via a connection to ground node 121. Capacitor 460 charging via diode 462 shifts the signal at circuit node 461 to ground potential. As the signal at circuit node 461 rises with the signal at circuit node 144, circuit node 461 rises beginning from ground potential. Thus, diode 462 shifts the AC signal at circuit node 461 to include a minimum voltage at approximately ground potential rather than being centered at ground potential.

Diode 464 operates to rectify the high frequency signal at circuit node 461. During the portion of the cycle when the voltage level at circuit node 461 is greater than the voltage level at circuit node 465, current flows through diode 464 to provide $V_{DD}$ node 116 with power. During the portion of the cycle when the voltage level at circuit node 461 is lower than the voltage level at circuit node 465, diode 464 substantially blocks current from flowing back to circuit node 461.

Capacitor 466 filters the signal at circuit node 465. When the signal at circuit node 461 is near a peak, capacitor 466 is charged by current flowing through diode 464. When the signal at circuit node 461 returns to a voltage closer to ground potential, the charge of capacitor 466 retains circuit node 465 at a voltage level close to the peak of the signal. Diode 464 substantially blocks current from flowing back to circuit node 461, which is at a lower voltage. Capacitor 466 reduces the amount of AC component in the signal at circuit node 465 to provide a steadier DC voltage to $V_{DD}$ node 116.

Zener diodes are designed to allow current to flow from cathode to anode when a positive voltage exceeding the Zener diode breakdown voltage is applied to the cathode relative to the anode. When the breakdown voltage of a Zener diode is exceeded, current flows from the cathode to the anode of the Zener diode. Current flowing from cathode to anode is the reverse of typical diode current. Zener diodes maintain the voltage difference from cathode to anode at approximately the Zener diode breakdown voltage for a wide range of reverse currents, making Zener diodes useful for maintaining a circuit node at a desired voltage level.

Zener diode 476 has a cathode coupled to the base of BJT 478, and indirectly regulates the voltage at $V_{DD}$ node 116 by controlling current from circuit node 465 to $V_{DD}$ node 116 through the BJT. Zener diode 476 limits the voltage at circuit node 474, i.e., the base of BJT 478, to the breakdown voltage of Zener diode 476 by allowing current to flow from circuit node 474 to ground node 121 when the voltage at circuit node 474 rises above the Zener diode 476 breakdown voltage. Resistor 472 limits the current to ground node 121 through Zener diode 476. Capacitor 477 shunts high frequency signals to ground node 121 to reduce the amount of noise from circuit node 144 that reaches $V_{DD}$ node 116.

BJT 478 operates as a switch, allowing current to flow from circuit node 465 to $V_{DD}$ node 116 when the $V_{DD}$ node is below the Zener diode 476 breakdown voltage and circuit node 465 is above the Zener diode 476 breakdown voltage. When circuit node 465 is above the breakdown voltage of Zener diode 476, current flows from circuit node 465, through resistor 472 and Zener diode 476, to ground node 121. Zener diode 476 maintains circuit node 474 at approximately the breakdown voltage of Zener diode 476. If $V_{DD}$ node 116 is below the Zener breakdown voltage, than a positive voltage exists at circuit node 474, i.e., the base of BJT 478, relative to $V_{DD}$ node 116, i.e., the emitter of BJT 478, which turns on BJT 478. With BJT 478 turned on, current flows from circuit node 465 to $V_{DD}$ node 116 to raise the voltage at the $V_{DD}$ node. Once $V_{DD}$ node 116 rises to near the Zener diode 476 breakdown voltage, a positive voltage will no longer exist at the base of BJT 478 relative to the emitter of BJT 478. BJT 478 turns off, and $V_{DD}$ node 116 is prevented from rising above the Zener diode 476 breakdown voltage even if circuit node 465 is higher. $V_{DD}$ node 116 is regulated at approximately the Zener diode 476 breakdown voltage by the operation of resistor 472, Zener diode 476, and BJT 478 controlling current from circuit node 465 to $V_{DD}$ node 116.

The high frequency signal at circuit node 144 is converted to a DC signal on $V_{DD}$ node 116 more efficiently than the lower frequency AC signal input at AC neutral node 110 and AC live node 112. Regenerating power source 96 provides a secondary power tapped from inductor 370 to provide power to LED driver 90 with lower power consumption, which boosts the overall AC to DC conversion efficiency of power supply 70. Therefore, providing power to $V_{DD}$ node 116 from regenerating power source 96 and disconnecting logic power source 82 when possible is advantageous. Using a non-isolated load, with an inductor having a single coil, and configuring power supply 70 so that negative LED node 140 is electrically coupled to the voltage source for the coil, i.e., $V_{CC}$ node 114, provides for a signal at circuit node 144 that has a higher amplitude than in other configurations. When MOSFET 372 is on, circuit node 144 is coupled to ground node 121 and at a lower voltage potential than $V_{CC}$ node 114. When MOSFET 372 is off, circuit node 144 is not coupled to ground node 121 and is at a higher voltage potential than $V_{CC}$ node 114.

Regenerating power source 96 provides a higher efficiency power source for LED driver 90. In scenarios where LED light engine 24 uses less power, LED driver 90 consumes a higher percentage of the total power consumption of LED lamp 10. Thus, regenerating power source 96 has a larger benefit to the overall power efficiency in lower power uses.

Figure 12:
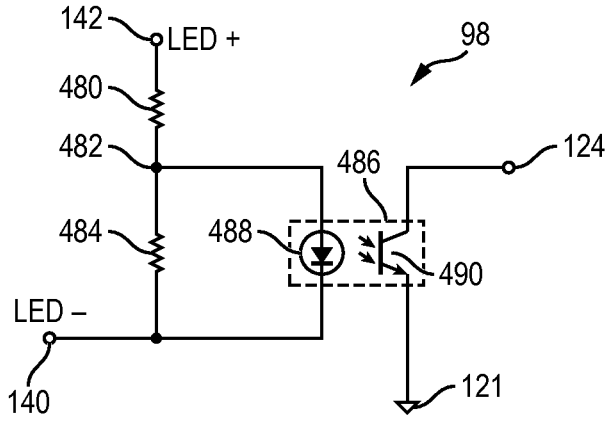
FIG. 12 is a schematic diagram of the open circuit protection for the power supply.

FIG. 12 is a schematic of open circuit protection 98. Open circuit protection 98 has negative LED node 140 and positive LED node 142 as inputs, and an output at circuit node 124 coupled to pins 3 and 4 of LED driver 90. Resistor 480 is coupled between positive LED node 142 and circuit node 482. Resistor 484 is coupled between circuit node 482 and negative LED node 140. Optocoupler 486 includes LED 488 and phototransistor 490. LED 488 has an anode coupled to circuit node 482 and a cathode coupled to negative LED node 140. Phototransistor 490 has a collector coupled to circuit node 124 and an emitter coupled to ground node 121.

Resistor 480 and resistor 484 form a voltage divider between positive LED node 142 and negative LED node 140. The values of resistors 480 and 484 are selected such that the voltage difference between negative LED node 140 and circuit node 482 is greater than the turn-on voltage of LED 488 if the voltage between negative LED node 140 and positive LED node 142 is greater than the turn-on voltage of LED light engine 24. The voltage difference between negative LED node 140 and positive LED node 142 has a known value under normal operation, i.e., the turn-on voltage of LED light engine 24. A voltage above the turn-on voltage of LED light engine 24 between negative LED node 140 and positive LED node 142 indicates to open circuit protection 98 that there is a problem with the LED light engine, and the open circuit protection disables LED driver 90 by coupling pins 3 and 4 of the LED driver to ground node 121.

An abnormal voltage difference between negative LED node 140 and circuit node 482 turns on LED 488. LED 488 emits photons in the form of near infrared light. LED 488 and phototransistor 490 are packaged together in close proximity, so that the photons emitted by LED 488 hit the phototransistor. Photons hitting the base-collector junction of phototransistor 490 turn on the phototransistor. When phototransistor 490 is turned on, current flows from circuit node 124 (connected to pins 3 and 4 of LED driver 90) to ground node 121. With pins 3 and 4 of LED driver 90 at a voltage potential near ground node 121, LED driver 90 reduces the on-time of the signal to MOSFET 372 of DC power driver 92. Current through the DC power driver is effectively limited.

Figure 13:
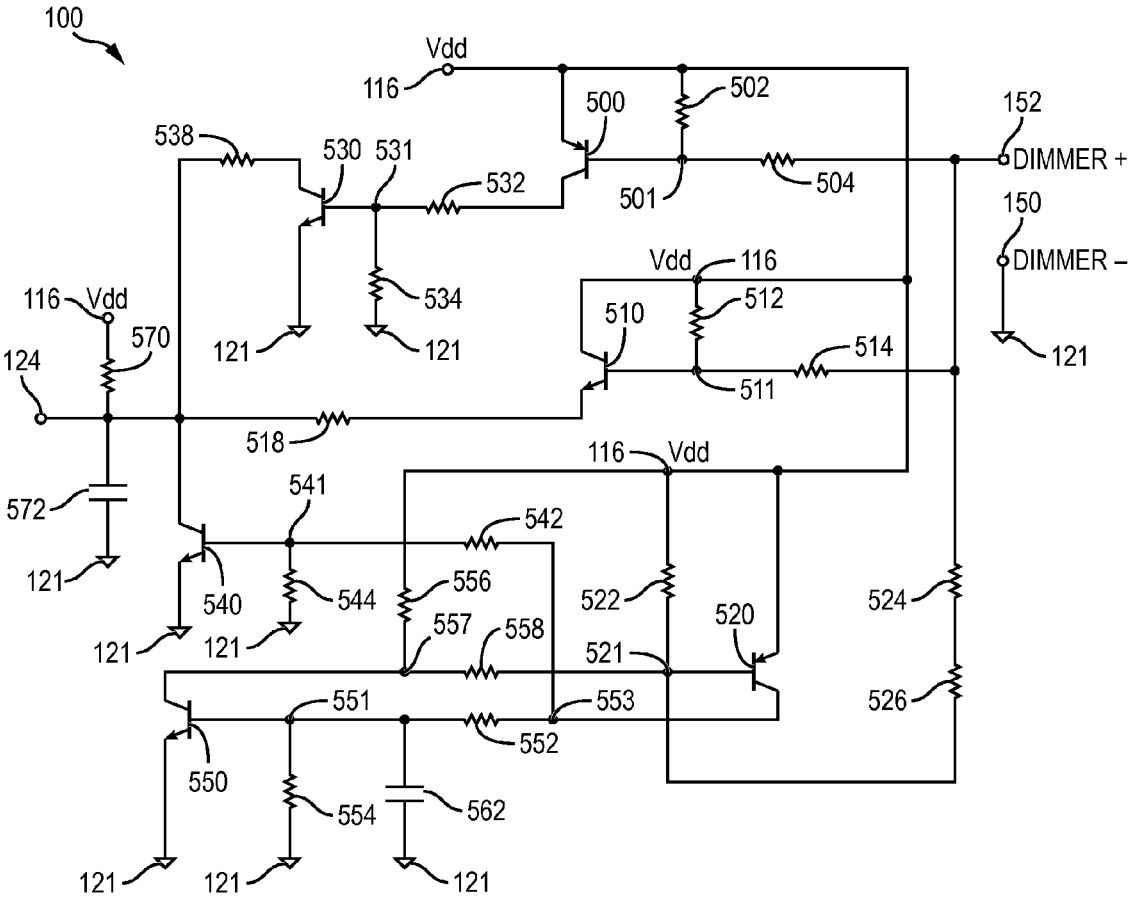
FIG. 13 is a schematic diagram of the dimming controller for the power supply.

FIG. 13 illustrates a 0-10V dimmer controller circuit 100 for use with power supply 70. Dimmer controller 100 accepts an analog dimming signal at dimmer– node 150 and dimmer+ node 152. Dimmer– node 150 is coupled to ground node 121 so that the signal at dimmer+ node 152 is 0-10V relative to the same ground potential as is used for the rest of power supply 70, including LED driver 90. Dimmer controller 100 includes circuitry to convert the 0-10V signal at dimmer+ node 152 to a signal at circuit node 124 that is at a voltage range usable by LED driver 90, in particular, to a range expected by the LED driver at pins 3 and 4. In one embodiment, the 0-10V signal at dimmer+ node 152 is converted to a signal at circuit node 124 that varies between 0V and $V_{DD}$. When the dimming signal at dimmer+ node 152 is received at 0V, e.g., the same voltage as dimmer– node 150, the output at circuit node 124 is approximately equal to the potential at ground node 121. When the input at dimmer+ node 152 is received as 10V, the output at circuit node 124 is approximately equal to $V_{DD}$. At input values between 0V and 10V, the output at circuit node 124 includes a linear or other relationship with the input at dimmer+ node 152.

Dimmer controller 100 includes PNP BJT 500. BJT 500 includes an emitter coupled to $V_{DD}$ node 116, a base coupled to circuit node 501, and a collector coupled to resistor 532. Resistor 502 is coupled between $V_{DD}$ node 116 and circuit node 501. Resistor 504 is coupled between circuit node 501 and dimmer+ node 152. Resistors 502 and 504 form a voltage divider between $V_{DD}$ node 116 and dimmer+ node 152, with the middle of the voltage divider connected to the base of BJT 500.

Dimmer controller 100 includes NPN BJT 510. BJT 510 includes an emitter coupled to resistor 518, a base coupled to circuit node 511, and a collector coupled to $V_{DD}$ node 116. Resistor 512 is coupled between $V_{DD}$ node 116 and circuit node 511. Resistor 514 is coupled between circuit node 511 and dimmer+ node 152. Resistors 512 and 514 form a voltage divider between $V_{DD}$ node 116 and dimmer+ node 152, with the middle of the voltage divider connected to the base of BJT 510. Resistor 518 is coupled between the emitter of BJT 510 and circuit node 124.

Dimmer controller 100 includes PNP BJT 520. BJT 520 includes an emitter coupled to $V_{DD}$ node 116, a base coupled to circuit node 521, and a collector coupled to circuit node 553. Resistor 522 is coupled between circuit node 521 and $V_{DD}$ node 116. Resistor 524 and resistor 526 are coupled in series between dimmer+ node 152 and circuit node 521. Resistors 522, 524, and 526 form a voltage divider between $V_{DD}$ node 116 and dimmer+ node 152, with the middle of the voltage divider connected to the base of BJT 520.

Dimmer controller 100 includes NPN BJT 530. BJT 530 includes an emitter coupled to ground node 121, a base coupled to circuit node 531, and a collector coupled to resistor 538. Resistor 532 is coupled between circuit node 531 and the collector of BJT 500. Resistor 534 is coupled between circuit node 531 and ground node 121. Resistor 538 is coupled between the collector of BJT 530 and circuit node 124.

Dimmer controller 100 includes NPN BJT 540. BJT 540 includes an emitter coupled to ground node 121, a base coupled to circuit node 541, and a collector coupled to circuit node 124. Resistor 542 is coupled between circuit node 553 and circuit node 541. Resistor 544 is coupled between circuit node 541 and ground node 121.

Dimmer controller 100 includes NPN BJT 550. BJT 550 includes an emitter coupled to ground node 121, a base coupled to circuit node 551, and a collector coupled to circuit node 557. Resistor 552 is coupled between circuit node 551 and circuit node 553. Resistor 554 is coupled between circuit node 551 and ground node 121. Resistor 556 is coupled between circuit node 557 and $V_{DD}$ node 116. Resistor 558 is coupled between circuit node 557 and circuit node 521. Capacitor 562 is coupled between circuit node 551 and ground node 121.

Resistor 570 is coupled between $V_{DD}$ node 116 and circuit node 124 as a pull-up resistor for pins 3 and 4 of LED driver 90. Capacitor 572 is coupled between circuit node 124 and ground node 121 as a filter capacitor for the signal at circuit node 124.

When dimmer+ input 152 is at 0V, circuit node 124 is output to pins 3 and 4 of LED driver 90 at approximately ground potential, i.e., approximately 0V. The voltage at circuit node 501 varies in proportion with dimmer+ node 152, and is at a minimum. Therefore, the emitter-base junction of BJT 500 is forward biased. $V_{DD}$ node 116 is coupled to circuit node 531 through BJT 500 and resistor 532. Therefore, circuit node 531 is at a maximum when dimmer+ node 152 is at 0V. With circuit node 531 at a maximum, the base-emitter junction of BJT 530 is forward biased and circuit node 124 is coupled to ground node 121 through resistor 538 and BJT 530.

With dimmer+ input 152 at 0V, circuit node 511 is also at a minimum voltage potential. Resistors 512 and 514 are selected so that when dimmer+ node 152 is at 0V, the base-emitter junction of BJT 510 is not forward biased. BJT 510 is off, and circuit node 124 is not significantly coupled to $V_{DD}$ node 116 through BJT 510.

Moreover, circuit node 521 is at a minimum due to dimmer+ 152 being at a minimum. The emitter-base junction of BJT 520 is forward biased, and BJT 520 conducts electricity from $V_{DD}$ node 116 to circuit node 553. Therefore, circuit nodes 553 and 541 are at a maximum. The base-emitter junction of BJT 540 is forward biased, and circuit node 124 is coupled to ground node 121 through BJT 540. Circuit node 124 includes coupling to ground node 121 via BJT 540 and through resistor 538 and BJT 530 in series, but does not include significant coupling to $V_{DD}$ node 116 through BJT 510. Therefore, when dimmer+ input 152 is at 0V, circuit node 124 is at approximately ground potential. In other embodiments, BJTs 500, 510, 520, 530, 540, and 550 are biased such that circuit node 124 is slightly above ground potential when dimmer+ node 152 is at 0V.

When dimmer+ input 152 is at a maximum value, i.e., 10V, circuit node 124 is output to pins 3 and 4 of LED driver 90 at a maximum, i.e., approximately the same voltage potential as $V_{DD}$ node 116. The voltage at circuit node 501 varies with changes in voltage at dimmer+ node 152. If $V_{DD}$ node 116 includes a voltage less than 10V, than the voltage at circuit node 501 will be higher than $V_{DD}$ node 116. The emitter-base junction of BJT 500 is reverse biased, and BJT 500 does not couple $V_{DD}$ node 116 to resistor 532 and circuit node 531. Circuit node 531 remains at approximately ground potential. The emitter and base of BJT 530 are both at approximately ground potential, so BJT 530 is off. BJT 530 does not provide significant coupling of circuit node 124 to ground node 121 via resistor 538.

Circuit node 521 will be at a maximum when dimmer+ node 152 is at a maximum. Circuit node 521 will be at a higher voltage than $V_{DD}$ node 116, and the emitter-base junction of BJT 520 will be reverse biased. Circuit node 551 will not be significantly coupled to $V_{DD}$ node 116 via BJT 520, and remains at approximately ground potential. Circuit node 541 is coupled to circuit node 551 and remains approximately at ground potential as well. The emitter and base of BJT 540 are both connected to approximately ground potential, and BJT 540 is off. With BJT 540 off, circuit node 124 is not provided with significant coupling to ground node 121 via BJT 540.

Circuit node 511 will be at a maximum when dimmer+ node 152 is at a maximum. The base-emitter junction of BJT 510 will be forward biased as long as the voltage at circuit node 124 is below the voltage at circuit node 511. $V_{DD}$ node 116 is coupled to circuit node 124 through BJT 510 because BJT 510 is on, and circuit node 124 rises to approximately the same voltage potential as $V_{DD}$ node 116. BJT 510 remains on because the voltage at circuit node 511 is higher than the voltage at $V_{DD}$ node 116, and the base-emitter junction of BJT 510 remains forward biased even when circuit node 124 is at the same voltage as $V_{DD}$ node 116. Circuit node 124 is coupled to $V_{DD}$ node 116 via BJT 510, but is not significantly coupled to ground node 121 through BJT 530 and BJT 540. Therefore, circuit node 124 is at approximately the same voltage potential as $V_{DD}$ node 116 when dimmer+ node 152 is at 10V.

Circuit node 124 is coupled to pins 3 and 4 of LED driver 90. Open circuit protection 98 is also coupled to pins 3 and 4 of LED driver 90. Pins 3 and 4 of LED driver 90 control power output of LED light engine 24 by limiting the maximum current through inductor 370. The voltage at pins 3 and 4 is controllable in an analog manner by dimmer controller 100, or can be shut off by open circuit protection 98. Pins 3 and 4 each operate independently and have a similar effect on the power when used individually. In one embodiment, dimming controller 100 is coupled to pin 3, but not pin 4, of LED driver 90 while open circuit protection 98 is coupled only to pin 4. The opposite connection is also possible. Dimming controller 100 allows operation of power supply 70 with common 0-10V dimming mechanisms available on the market.

While one or more embodiments of the present invention have been illustrated in detail, the skilled artisan will appreciate that modifications and adaptations to the embodiments may be made without departing from the scope of the present invention as set forth in the following claims.

What is claimed:

1. A light-emitting diode (LED) lighting device, comprising:

an LED comprising a cathode of the LED connected to a voltage input terminal of the LED lighting device; and a power supply including, (a) an inductor including a first terminal connected to the cathode of the LED and a second terminal of the inductor connected to an anode of the LED, (b) a first transistor connected in series with the inductor between the voltage input terminal and a ground voltage terminal to enable current through the inductor, (c) a first diode including an anode electrically coupled to the second terminal of the inductor, (d) a controller including a first terminal connected to a control terminal of the first transistor and a second terminal connected to a cathode of the first diode, (e) a third transistor electrically coupled in series between the second terminal of the controller and the cathode of the first diode, (f) a second transistor connected between the voltage input terminal of the LED lighting device and the second terminal of the controller in parallel with the inductor, first diode, and third transistor, and (g) a dimming controller connected to a third terminal of the controller.

2. The LED lighting device of claim 1, further including a Zener diode comprising a cathode of the Zener diode connected to the second terminal of the controller.

3. The LED lighting device of claim 2, further including a capacitor coupled in parallel with the Zener diode.

4. The LED lighting device of claim 1, further including a second diode comprising a cathode of the second diode connected to the anode of the first diode and an anode of the second diode connected to the ground voltage terminal.

5. The LED lighting device of claim 1, where in a voltage potential of the anode of the LED is greater than a voltage potential of the voltage input terminal of the LED lighting device.

6. An electronic circuit for providing a direct current (DC) power signal, comprising:

a controller;

a first transistor including a control terminal connected to a first terminal of the controller;

an inductor including a first terminal of the inductor connected to a conduction terminal of the first transistor;

a capacitor including a first terminal of the capacitor connected to the first terminal of the inductor and a second terminal of the capacitor connected to a second terminal of the controller; and a second transistor comprising a first conduction terminal connected to a second terminal of the inductor and a second conduction terminal of the second transistor connected to the second terminal of the controller, wherein the second transistor is connected to the second terminal of the controller in parallel with the inductor and capacitor.

7. The electronic circuit of claim 6, wherein the inductor is configured to receive a power signal at the second terminal of the inductor.

8. The electronic circuit of claim 6, further including a first diode comprising an anode electrically coupled to the second terminal of the capacitor and a cathode of the first diode electrically coupled to the second terminal of the controller, wherein the first diode is electrically coupled in series between the second terminal of the capacitor and the second terminal of the controller.

9. The electronic circuit of claim 8, further including a second diode comprising a cathode of the second diode connected to the anode of the first diode and an anode of the second diode connected to a ground node.

10. The electronic circuit of claim 6, further including a latch connected in series between a power input of the electronic circuit and a third terminal of the controller.

11. The electronic circuit of claim 6, further including a Zener diode coupled to the second terminal of the controller.

12. The electronic circuit of claim 6, further including a dimming controller connected to a third terminal of the controller.

13. An electronic circuit for providing a direct current (DC) power signal, comprising:

a controller;

a first transistor including a control terminal connected to a first terminal of the controller;

an inductor including a first terminal of the inductor connected to a conduction terminal of the first transistor;

a capacitor including a first terminal of the capacitor connected to the first terminal of the inductor;

a first diode electrically coupled in series between a second terminal of the capacitor and a second terminal of the controller; and a second transistor electrically coupled in series between the first diode and the second terminal of the controller.

14. The electronic circuit of claim 13, wherein the inductor is configured to receive a power signal input to a second terminal of the inductor.

15. The electronic circuit of claim 13, further including a second diode connected between the first diode and a ground node.

16. The electronic circuit of claim 13, further including a latch connected to a third terminal of the controller.

17. The electronic circuit of claim 13, further including a Zener diode coupled to the second terminal of the controller.

18. The electronic circuit of claim 13, further including a dimming controller connected to a third terminal of the controller.

19. A method of making a circuit, comprising:

providing a controller;

providing a first transistor including a control terminal connected to a first terminal of the controller;

providing an inductor including a first terminal connected to a conduction terminal of the first transistor;

providing a capacitor including a first terminal of the capacitor coupled to the first terminal of the inductor and a second terminal of the capacitor coupled to a second terminal of the controller;

providing a second transistor electrically coupled in series between the capacitor and second terminal of the controller;

providing a first power signal at a first voltage level input to a second terminal of the inductor;

providing a dimmer circuit connected to a third terminal of the controller; and using the dimmer circuit to reduce a power output of the circuit while the first power signal remains at the first voltage level.

20. The method of claim 19, further including providing a diode electrically coupled in series between the capacitor and second terminal of the controller, wherein the diode is configured to rectify a second power signal at the second terminal of the capacitor.

21. The method of claim 19, further including providing a second transistor connected between a voltage input of the circuit and the second terminal of the controller.

22. The method of claim 19, further including configuring the circuit to include a greater voltage potential at the first terminal of the inductor than at the second terminal of the inductor.

* * * * *